US007996233B2

(12) United States Patent
Oshikiri

(10) Patent No.: US 7,996,233 B2
(45) Date of Patent: Aug. 9, 2011

(54) ACOUSTIC CODING OF AN ENHANCEMENT FRAME HAVING A SHORTER TIME LENGTH THAN A BASE FRAME

(75) Inventor: Masahiro Oshikiri, Yokosuka (JP)

(73) Assignee: Panasonic Corporation, Osaka (JP)

( * ) Notice: Subject to any disclaimer, the term of this patent is extended or adjusted under 35 U.S.C. 154(b) by 657 days.

(21) Appl. No.: 10/526,566

(22) PCT Filed: Aug. 12, 2003

(86) PCT No.: PCT/JP03/10247

§ 371 (c)(1),
(2), (4) Date: Mar. 4, 2005

(87) PCT Pub. No.: WO2004/023457

PCT Pub. Date: Mar. 18, 2004

(65) Prior Publication Data

US 2005/0252361 A1 Nov. 17, 2005

(30) Foreign Application Priority Data

Sep. 6, 2002 (JP) ..... 2002-261549

(51) Int. Cl.
*G10L 19/00* (2006.01)
*G10L 11/00* (2006.01)
*G10L 11/04* (2006.01)

(52) U.S. Cl. ..... 704/500; 704/219; 704/220; 704/207; 704/501; 704/200; 704/200.1

(58) Field of Classification Search ..... 704/219, 704/220, 207, 500, 501, 200.1, 200
See application file for complete search history.

(56) References Cited

U.S. PATENT DOCUMENTS 5,675,705 A * 10/1997 Singhal ..... 704/254
5,752,222 A 5/1998 Nishiguchi et al.
5,911,130 A * 6/1999 Shimizu et al. ..... 704/500
5,970,443 A * 10/1999 Fujii ..... 704/222

(Continued)

FOREIGN PATENT DOCUMENTS

DE 101 02 159 8/2002

(Continued)

OTHER PUBLICATIONS

S.N. Levine and J.O. Smith, "A switched parametric & transform audio coder," in Proc. ICASSP, 1999, pp. 985-988.*

(Continued)

*Primary Examiner* — Paras Shah
(74) *Attorney, Agent, or Firm* — Dickinson Wright PLLC

(57) ABSTRACT

A downsampler 101 converts input data having a sampling rate 2*FH to a sampling rate 2*FL which is lower than the sampling rate 2*FH. A base layer coder 102 encodes the input data having the sampling rate 2*FL in predetermined base frame units. A local decoder 103 decodes a first coded code. An upsampler 104 increases the sampling rate of the decoded signal to 2*FH. A subtractor 106 subtracts the decoded signal from the input signal and regards the subtraction result as a residual signal. A frame divider 107 divides the residual signal into enhancement frames having a shorter time length than that of the base frame. An enhancement layer coder 108 encodes the residual signal divided into the enhancement frames and outputs a second coded code obtained by this coding to a multiplexer 109.

11 Claims, 26 Drawing Sheets

U.S. PATENT DOCUMENTS

| | | | | |
|---|---|---|---|---|
| 6,208,957 | B1 | 3/2001 | Nomura | |
| 6,246,345 | B1 * | 6/2001 | Davidson et al. | 704/229 |
| 6,266,644 | B1 * | 7/2001 | Levine | 704/503 |
| 6,446,037 | B1 * | 9/2002 | Fielder et al. | 704/229 |
| 6,658,382 | B1 * | 12/2003 | Iwakami et al. | 704/500 |
| 6,934,676 | B2 * | 8/2005 | Wang et al. | 704/200.1 |
| 6,973,574 | B2 * | 12/2005 | Mihcak et al. | 713/180 |
| 6,979,236 | B1 * | 12/2005 | Stanton | 439/783 |
| 7,136,418 | B2 * | 11/2006 | Atlas et al. | 375/242 |
| 2002/0007273 | A1 * | 1/2002 | Chen | 704/229 |
| 2002/0107686 | A1 * | 8/2002 | Unno | 704/219 |
| 2002/0116189 | A1 * | 8/2002 | Yeh et al. | 704/248 |
| 2004/0049376 | A1 * | 3/2004 | Sperschneider et al. | 704/200.1 |
| 2004/0162911 | A1 | 8/2004 | Sperschneider et al. | |

FOREIGN PATENT DOCUMENTS

| | | | | |
|---|---|---|---|---|
| EP | 0890943 | | | 1/1999 |
| EP | 0942411 | A2 | | 9/1999 |
| EP | 1087378 | A1 | | 3/2001 |
| EP | 1173028 | | | 1/2002 |
| JP | 08046517 | A | * | 2/1996 |
| JP | 08263096 | | | 10/1996 |
| JP | 8263096 | | | 10/1996 |
| JP | 9127996 | | | 5/1997 |
| JP | 10207496 | A | * | 8/1998 |
| JP | 10285046 | | | 10/1998 |
| JP | 1130997 | | | 2/1999 |
| JP | 11330977 | | | 11/1999 |
| JP | 20003193 | | | 1/2000 |
| JP | 2000322097 | A | * | 11/2000 |
| JP | 2001230675 | | | 8/2001 |

OTHER PUBLICATIONS

Painter, T.; Spanias, A., "Perceptual coding of digital audio," Proceedings of the IEEE, vol. 88, No. 4, pp. 451-515, Apr. 2000.*

H. Najafzadeh-Azghandi and P. Kabal, "Perceptual bit allocation for low rate coding of narrowband audio," in Proc. IEEE Int. Conf. on Acoustics, Speech, Signal Processing, (Istanbul), pp. 893-896, Jun. 2000.*

PCT International Search Report dated Sep. 16, 2003.

M. R. Schroeder, et al.; Code-Excited Linear Prediction (CELP) High-Quality Speech at Very Low Bit Rates, Proc. ICASSP 85, pp. 937-940, 1985.

Japanese Office Action dated Apr. 5, 2005 with English translation.

European Search Report dated Nov. 21, 2005.

European Search Report dated Mar. 21, 2011.

* cited by examiner

ACOUSTIC CODING OF AN ENHANCEMENT FRAME HAVING A SHORTER TIME LENGTH THAN A BASE FRAME

APPARATUS AND METHOD FOR ACOUSTIC CODING

This application is a national phase application of international application number PCT/JP2003/010247 filed Aug. 12, 2003, which claims priority based on JP 2002/261549filed Sep. 6, 2002.

TECHNICAL FIELD

The present invention relates to an acoustic coding apparatus and acoustic coding method which compresses and encodes an acoustic signal such as a music signal or speech signal with a high degree of efficiency, and more particularly, to an acoustic coding apparatus and acoustic coding method which carries out scalable coding capable of even decoding music and speech from part of a coded code.

BACKGROUND ART

An acoustic coding technology which compresses a music signal or speech signal at a lowbit rate is important for effective utilization of a transmission path capacity of radio wave, etc., in a mobile communication and a recording medium. As speech coding methods for coding a speech signal, there are methods like G726, G729 which are standardized by the ITU (International Telecommunication Union). These methods can perform coding on a narrowband signal (300 Hz to 3.4 kHz) at a bit rate of 8 kbit/s to 32 kbit/s with high quality.

Furthermore, there are standard methods for coding a wideband signal (50 Hz to 7 kHz) like G722, G722.1 of the ITU and AMR-WB of the 3GPP (The 3rd Generation Partnership Project). These methods can perform coding on a wideband speech signal at a bit rate of 6.6 kbit/s to 64 kbit/s with high quality.

A method for effectively performing coding on a speech signal at a low bit rate with a high degree of efficiency is CELP (Code Excited Linear Prediction). Based on an engineering simulating model of a human speech generation model, the CELP is a method of causing an excitation signal expressed by a random number or pulse string to pass through a pitch filter corresponding to the intensity of periodicity and a synthesis filter corresponding to a vocal tract characteristic and determining coding parameters so that the square error between the output signal and input signal becomes a minimum under weighting of a perceptual characteristic. (For example, see "Code-Excited Linear Prediction (CELP): high quality speech at very low bit rates", Proc. ICASSP 85, pp. 937-940, 1985.)

Many recent standard speech coding methods are based on the CELP. For example, G729 can perform coding on a narrowband signal at a bit rate of 8 kbit/s and AMR-WB can perform coding on a wideband signal at a bit rate of 6.6 kbit/s to 23.85 kbit/s.

On the other hand, in the case of audio coding where a music signal is encoded, transform coding is generally used which transforms a music signal to a frequency domain and encodes the transformed coefficients using a perceptual psychological model such as a MPEG-1 layer 3 coding and AAC coding standardized by MPEG (Moving Picture Expert Group). These methods are known to hardly produce deterioration at a bit rate of 64 kbit/s to 96 kbit/s per channel on a signal having a sampling rate of 44.1 kHz.

However, when a signal which consists predominantly of a speech signal with music and environmental sound superimposed in the background is encoded, applying a speech coding involves a problem that not only the signal in the background but also the speech signal deteriorates due to the influence of music and environmental sound in the background, degrading the overall quality. This is a problem caused by the fact that the speech coding is based on a method specialized for the speech model of the CELP. Furthermore, there is another problem that the signal band to which the speech coding is applicable is up to 7 kHz at most and signals having higher frequencies cannot be covered for structural reasons.

On the other hand, music coding (audio coding) methods allow high quality coding on music, and can thereby obtain sufficient quality for the aforementioned speech signal including music and environmental sound in the background, too. Furthermore, audio coding is applicable to a frequency band of target signals having a sampling rate of up to approximately 22 kHz, which is equivalent to CD quality.

On the other hand, to realize high quality coding, it is necessary to use signals at a high bit rate and the problem is that if the bit rate is mitigated to as low as approximately 32 kbit/s, the quality of the decoded signal degrades drastically. This results in a problem that the method cannot be used for a communication network having a low transmission bit rate.

In order to avoid the above described problems, it is possible to adopt scalable coding combining these technologies which performs coding on an input signal in a base layer using CELP first and then calculates a residual signal obtained by subtracting the decoded signal from the input signal and carries out transform coding on this signal in an enhancement layer.

According to this method, the base layer uses CELP and can thereby perform coding on a speech signal with high quality and the enhancement layer can efficiently perform coding on music and environmental sound in the background which cannot be expressed by the base layer and signals with a higher frequency component than the frequency band covered by the base layer. Furthermore, according to this configuration, it is possible to suppress the bit rate to a low level. In addition, this configuration allows an acoustic signal to be decoded from only part of a coded code, that is, a coded code of the base layer and such a scalable function is effective in realizing multicasting to a plurality of networks having different transmission bit rates.

However, such scalable coding has a problem that delays in the enhancement layer increase. This problem will be explained using FIG. 1 and FIG. 2. FIG. 1 illustrates an example of frames of a base layer (base frames) and frames of an enhancement layer (enhancement frames) in conventional speech coding. FIG. 2 illustrates an example of frames of a base layer (base frames) and frames of an enhancement layer (enhancement frames) in conventional speech decoding.

In the conventional speech coding, the base frames and enhancement frames are constructed of frames having an identical time length. In FIG. 1, an input signal input from time T(n−1) to T(n) becomes an nth base frame and is encoded in the base layer. And a residual signal from time T(n−1) to T(n) is also coded in the enhancement layer.

Here, when an MDCT (modified discrete cosine transform) is used in the enhancement layer, it is necessary to make two successive MDCT analysis frames overlap with each other by half the analysis frame length. This overlapping is performed to prevent discontinuity between the frames in the synthesis process.

In the case of an MDCT, an orthogonal basis is designed to hold orthogonally not only within an analysis frame but also between successive analysis frames, and therefore overlapping successive analysis frames with each other and adding up the two in the synthesis process prevents distortion from occurring due to discontinuity between frames. In FIG. 1, the nth analysis frame is set to a length of T(n−2) to T(n) and coding processing is performed.

Decoding processing generates a decoded signal consisting of the nth base frame and the nth enhancement frame. The enhancement layer performs an IMDCT (inverse modified discrete cosine transform) and as described above, it is necessary to overlap the decoded signal of the nth enhancement frame with the decoded signal of the preceding frame (the (n−1)th enhancement frame in this case) by half the synthesized frame length and add up the two. For this reason, the decoding processing section can only generate up to the signal at time T(n−1).

That is, a delay (time length of T(n)−T (n−1) in this case) of the same length as that of the base frame as shown in FIG. 2 occurs. If the time length of the base frame is assumed to be 20 ms, a newly produced delay in the enhancement layer is 20 ms. Such an increase of delay constitutes a serious problem in realizing a speech communication service.

As shown above, the conventional apparatus has a problem that it is difficult to perform coding on a signal which consists predominantly of speech with music and noise superimposed in the background, with a short delay, at a low bit rate and with high quality.

DISCLOSURE OF INVENTION

It is an object of the present invention to provide an acoustic coding apparatus and acoustic coding method capable of performing coding on even a signal which consists predominantly of speech with music and noise superimposed in the background, with a short delay, at a low bit rate and with high quality.

This object can be attained by performing coding on an enhancement layer with the time length of enhancement layer frames set to be shorter than the time length of base layer frames and performing coding on a signal which consists predominantly of speech with music and noise superimposed in the background, with a short delay, at a low bit rate and with high quality.

BEST MODE FOR CARRYING OUT THE INVENTION

With reference now to the attached drawings, embodiments of the present invention will be explained below.

The present inventor has come up with the present invention by noting that the time length of a base frame which is a coded input signal is the same as the time length of an enhancement frame which is a coded difference between the input signal and a signal obtained by decoding the coded input signal and this causes a long delay at the time of demodulation.

That is, an essence of the present invention is to perform coding on an enhancement layer with the time length of enhancement layer frames set to be shorter than the time length of base layer frames and perform coding on a signal which consists predominantly of speech with music and noise superimposed in the background, with a short delay, at a low bit rate and with high quality.

Embodiment 1

Figure 3:
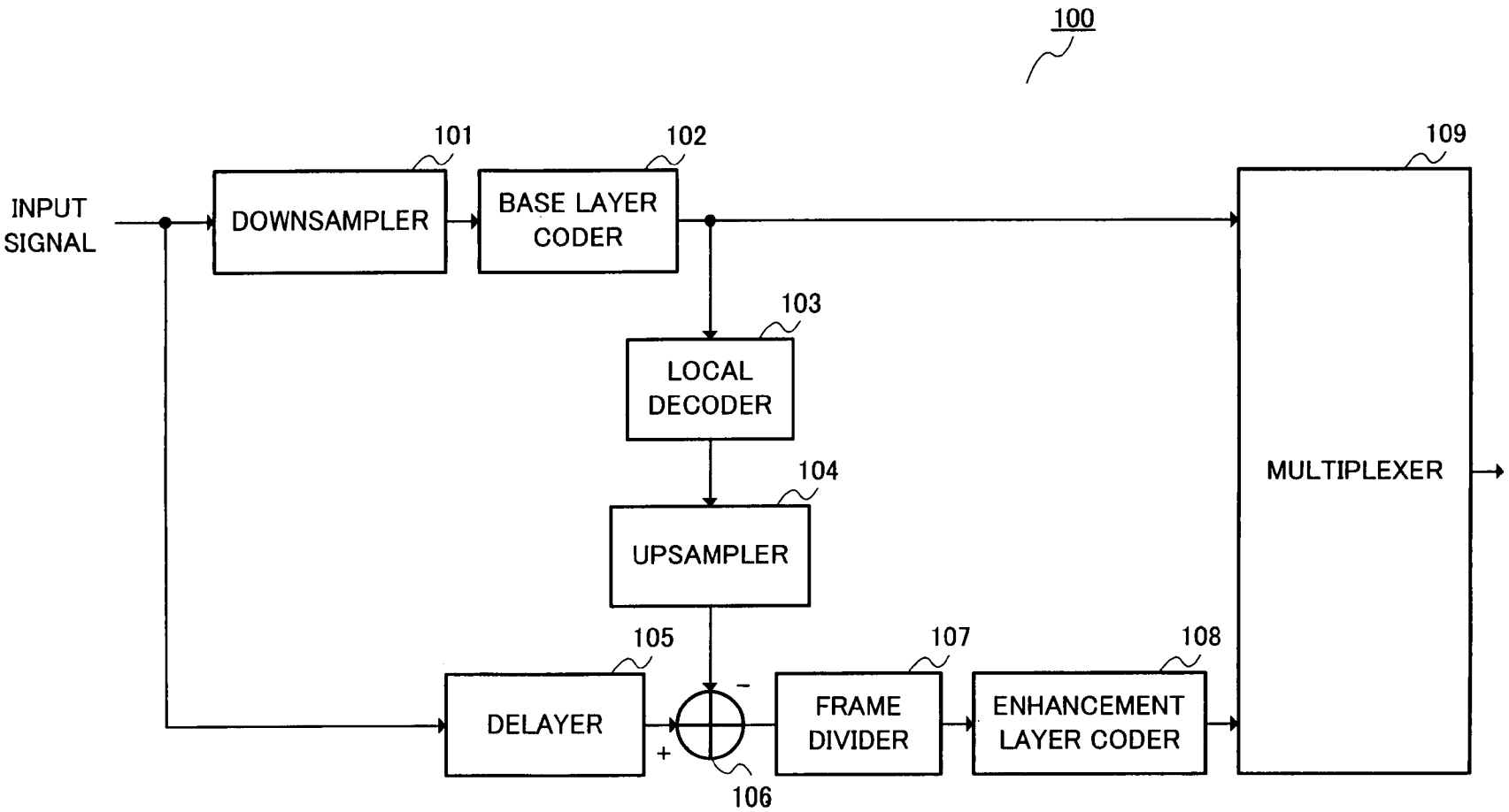
FIG. 3 is a block diagram showing the configuration of an acoustic coding apparatus according to Embodiment 1 of the present invention.

FIG. 3 is a block diagram showing the configuration of an acoustic coding apparatus according to Embodiment 1 of the present invention. An acoustic coding apparatus 100 in FIG. 3 is mainly constructed of a downsampler 101, a base layer coder 102, a local decoder 103, an upsampler 104, a delayer 105, a subtractor 106, a frame divider 107, an enhancement layer coder 108 and a multiplexer 109.

In FIG. 3, the downsampler 101 receives input data (acoustic data) of a sampling rate 2*FH, converts this input data to a sampling rate 2*FL which is lower than the sampling rate 2*FH and outputs the input data to the base layer coder 102.

The base layer coder 102 encodes the input data of the sampling rate 2*FL in units of a predetermined base frame and outputs a first coded code which is the coded input data to the local decoder 103 and multiplexer 109. For example, the base layer coder 102 encodes the input data according to a CELP coding.

The local decoder 103 decodes the first coded code and outputs the decoded signal obtained by the decoding to the upsampler 104. The upsampler 104 increases the sampling rate of the decoded signal to 2*FH and outputs the decoded signal to the subtractor 106.

The delayer 105 delays the input signal by a predetermined time and outputs the delayed input signal to the subtractor 106. Setting the length of this delay to the same value as the time delay produced in the downsampler 101, base layer coder 102, local decoder 103 and upsampler 104 prevents a phase shift in the next subtraction processing. For example, suppose this delay time is the sum total of processing times at the downsampler 101, base layer coder 102, local decoder 103 and upsampler 104. The subtractor 106 subtracts the decoded signal from the input signal and outputs the subtraction result to the frame divider 107 as a residual signal.

The frame divider 107 divides the residual signal into enhancement frames having a shorter time length than that of the base frame and outputs the residual signal divided into the enhancement frames to the enhancement layer coder 108. The enhancement layer coder 108 encodes the residual signal divided into the enhancement frames and outputs a second coded code obtained by this coding to the multiplexer 109. The multiplexer 109 multiplexes the first coded code and second coded code to output the multiplexed code.

Next, the operation of the acoustic coding apparatus according to this embodiment will be explained. Here, an example where an input signal which is acoustic data of sampling rate 2*FH is encoded will be explained.

The input signal is converted to the sampling rate 2*FL which is lower than the sampling rate 2*FH by the downsampler 101. Then, the input signal of the sampling rate 2*FL is encoded by the base layer coder 102. The coded input signal is decoded by the local decoder 103 and a decoded signal is generated. The decoded signal is converted to the sampling rate 2*FH which is higher than the sampling rate 2*FL by the upsampler 104.

After being delayed by a predetermined time by the delayer 105, the input signal is output to the subtractor 106. A residual signal is obtained by the subtractor 106 calculating a difference between the input signal which has passed through the delayer 105 and the decoded signal converted to the sampling rate 2*FH.

The residual signal is divided by the frame divider 107 into frames having a shorter time length than the frame unit of coding at the base layer coder 102. The divided residual signal is encoded by the enhancement layer coder 108. The coded code generated by the base layer coder 102 and the coded code generated by the enhancement layer coder 108 are multiplexed by the multiplexer 109.

Figure 4:
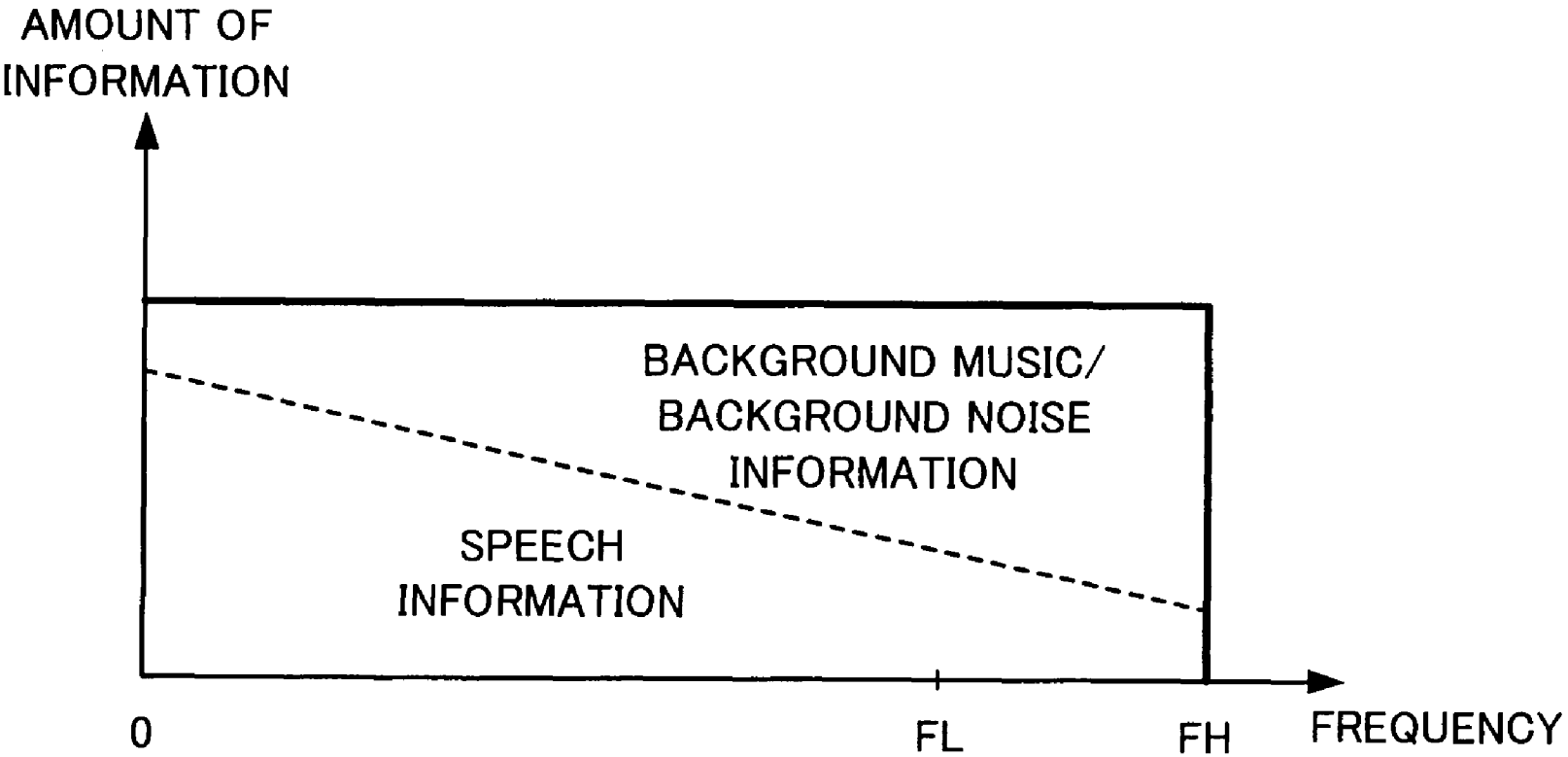
FIG. 4 illustrates an example of the distribution of information on an acoustic signal.

Signals coded by the base layer coder 102 and enhancement layer coder 108 will be explained below. FIG. 4 shows an example of the distribution of information of an acoustic signal. In FIG. 4, the vertical axis shows an amount of information and the horizontal axis shows a frequency. FIG. 4 shows in which frequency band and how much speech information, background music and background noise information included in the input signal exist.

As shown in FIG. 4, the speech information has more information in a low frequency domain and the amount of information decreases as the frequency increases. On the other hand, the background music and background noise information have relatively a smaller amount of low band information than the speech information and have more information included in a high band.

Therefore, the base layer encodes the speech signal with high quality using CELP coding, while the enhancement layer encodes music in the background and environmental sound which cannot be expressed by the base layer and signals of higher frequency components than the frequency band covered by the base layer efficiently.

Figure 5:
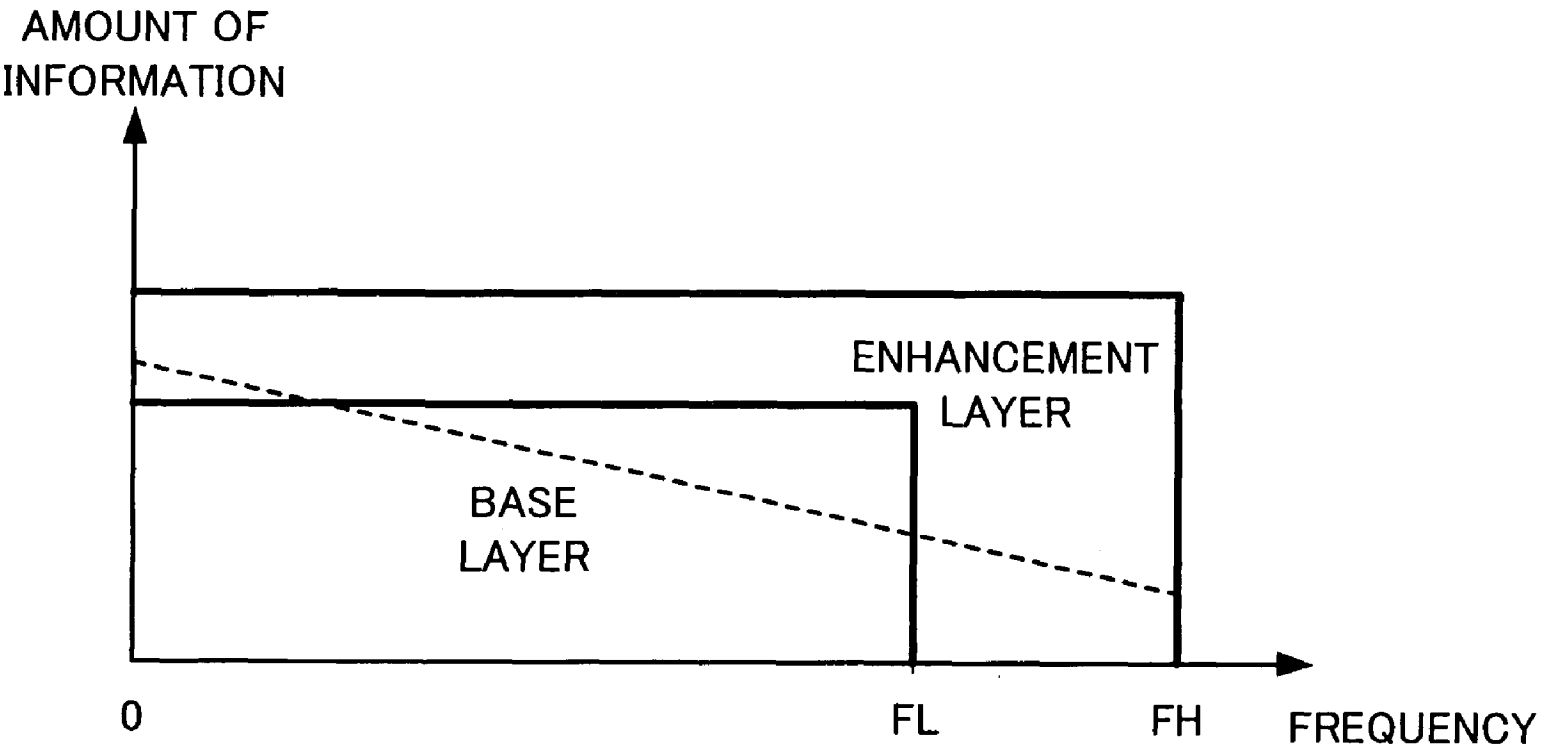
FIG. 5 illustrates an example of domains to be coded of a base layer and enhancement layer.

FIG. 5 shows an example of domains to be coded by the base layer and enhancement layer. In FIG. 5, the vertical axis shows an amount of information and the horizontal axis shows a frequency. FIG. 5 shows the domains of information to be coded by the base layer coder 102 and enhancement layer coder 108.

The base layer coder 102 is designed to efficiently express speech information in the frequency band from 0 to FL and can encode speech information in this domain with high quality. However, the base layer coder 102 does not have high coding quality of the background music and background noise information in the frequency band from 0 to FL.

The enhancement layer coder 108 is designed to cover the insufficient capacity of the base layer coder 102 explained above and signals in the frequency band from FL to FH. Therefore, combining the base layer coder 102 and enhancement layer coder 108 can realize coding with high quality in a wide band.

As shown in FIG. 5, since the first coded code obtained through coding by the base layer coder 102 includes speech information in the frequency band from 0 to FL, it is possible to realize at least the scalable function whereby a decoded signal is obtained by the first coded code alone.

The acoustic coding apparatus 100 in this embodiment sets the time length of a frame coded by this enhancement layer coder 108 sufficiently shorter than the time length of a frame coded by the base layer coder 102, and can thereby shorten delays produced in the enhancement layer.

Figure 6:
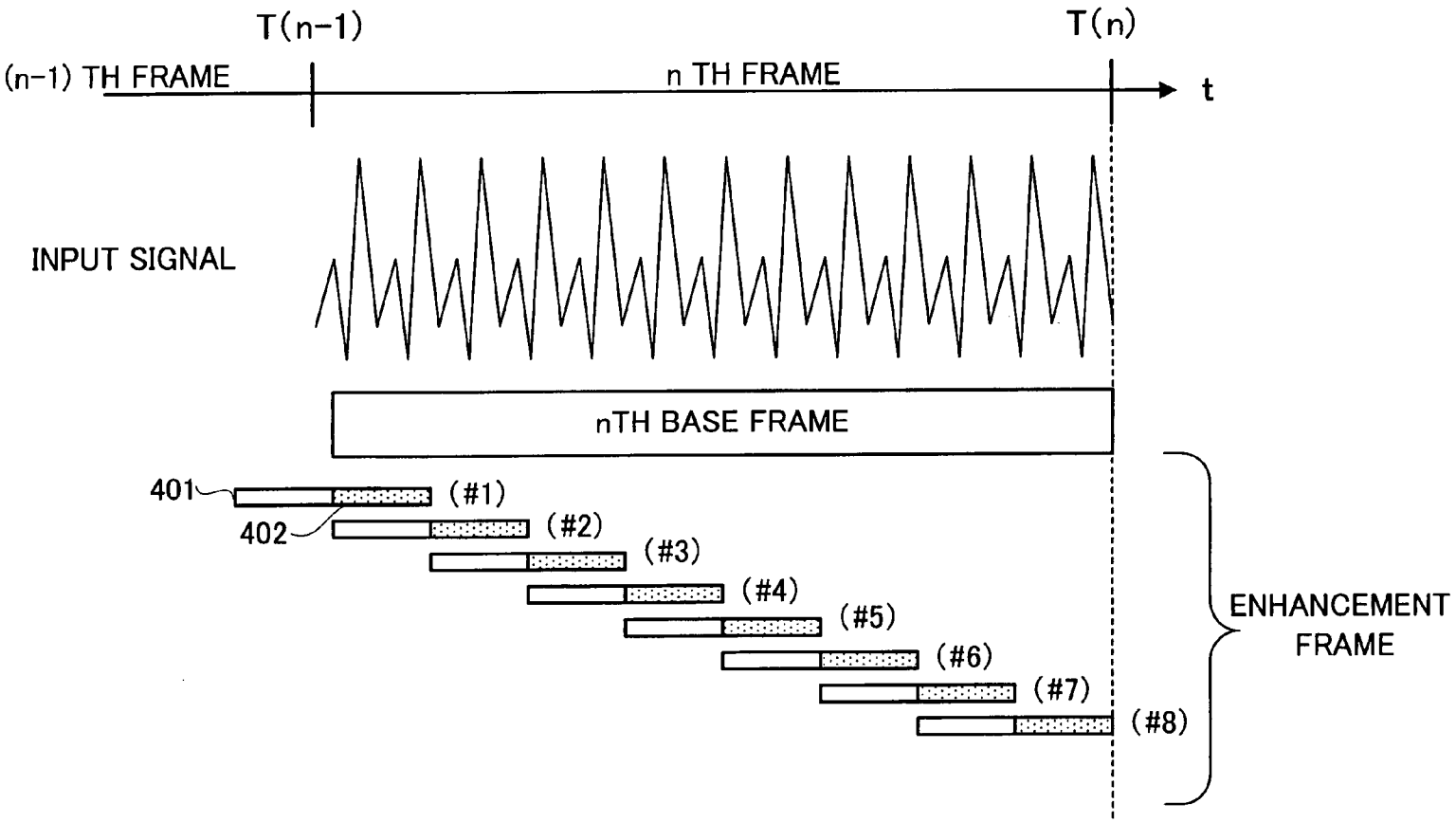
FIG. 6 illustrates an example of coding of a base layer and enhancement layer.

FIG. 6 illustrates an example of coding of the base layer and enhancement layer. In FIG. 6, the horizontal axis shows a time. In FIG. 6, an input signal from time T(n−1) to T(n) is processed as an nth frame. The base layer coder 102 encodes the nth frame as the nth base frame which is one base frame. On the other hand, the enhancement layer coder 108 encodes the nth frame by dividing it into a plurality of enhancement frames.

Here, the time length of a frame of the enhancement layer (enhancement frame) is set to 1/J with respect to the frame of the base layer (base frame). In FIG. 6, J=8 is set for convenience, but this embodiment is not limited to this value and any integer satisfying J≧2 can be used.

The example in FIG. 6 assumes J=8, and therefore eight enhancement frames correspond to one base frame. Hereafter, each enhancement frame corresponding to the nth base frame will be denoted as the nth enhancement frame (#j) (j=1 to 8). The analysis frame of each enhancement layer is set so that two successive analysis frames overlap with each other by half the analysis frame length to prevent discontinuity from occurring between the successive frames and subjected to coding processing. For example, in the nth enhancement frame (#1), the domain combining frame 401 and frame 402 becomes an analysis frame. Then, the decoding side decodes the signals obtained by coding the input signal explained above using the base layer and the enhancement layer.

Figure 7:
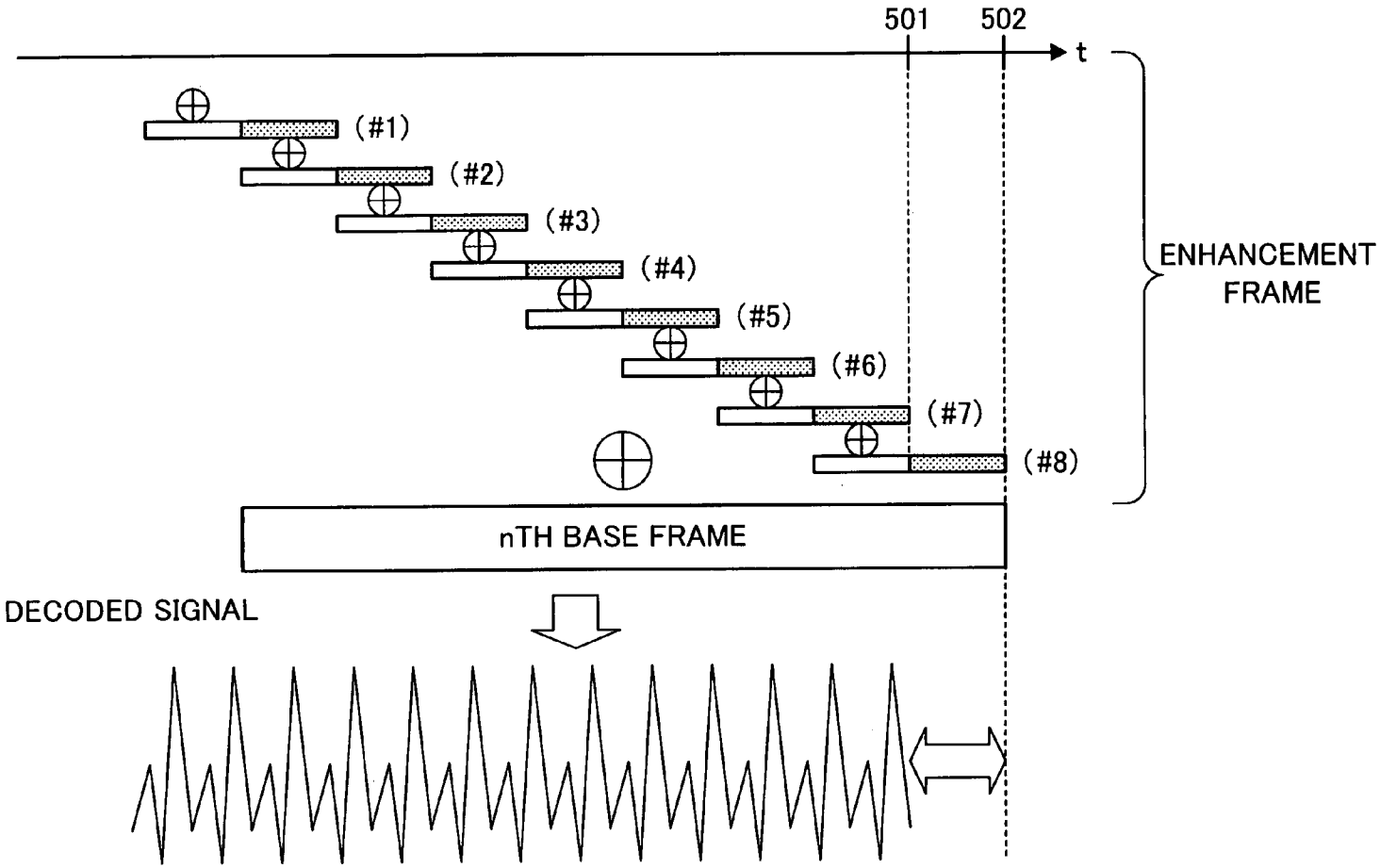
FIG. 7 illustrates an example of decoding of a base layer and enhancement layer.

FIG. 7 illustrates an example of decoding of the base layer and enhancement layer. In FIG. 7, the horizontal axis shows a time. In the decoding processing, a decoded signal of the nth base frame and a decoded signal of the nth enhancement frames are generated. In the enhancement layer, it is possible to decode a signal corresponding to the section in which an overlapping addition with the preceding frame is possible. In FIG. 7, a decoded signal is generated until time 501, that is, up to the position of the center of the nth enhancement frame (#8).

That is, according to the acoustic coding apparatus of this embodiment, the delay produced in the enhancement layer corresponds to time 501 to time 502, requiring only ⅛ of the time length of the base layer. For example, when the time length of the base frame is 20 ms, a delay newly produced in the enhancement layer is 2.5 ms.

This example is the case where the time length of the enhancement frame is set to ⅛ of the time length of the base frame, but in general when the time length of the enhancement frame is set to 1/J of the time length of the base frame, a delay produced in the enhancement layer becomes 1/J and it is possible to set J according to the length of the delay which can be allowed in a system.

Figure 8:
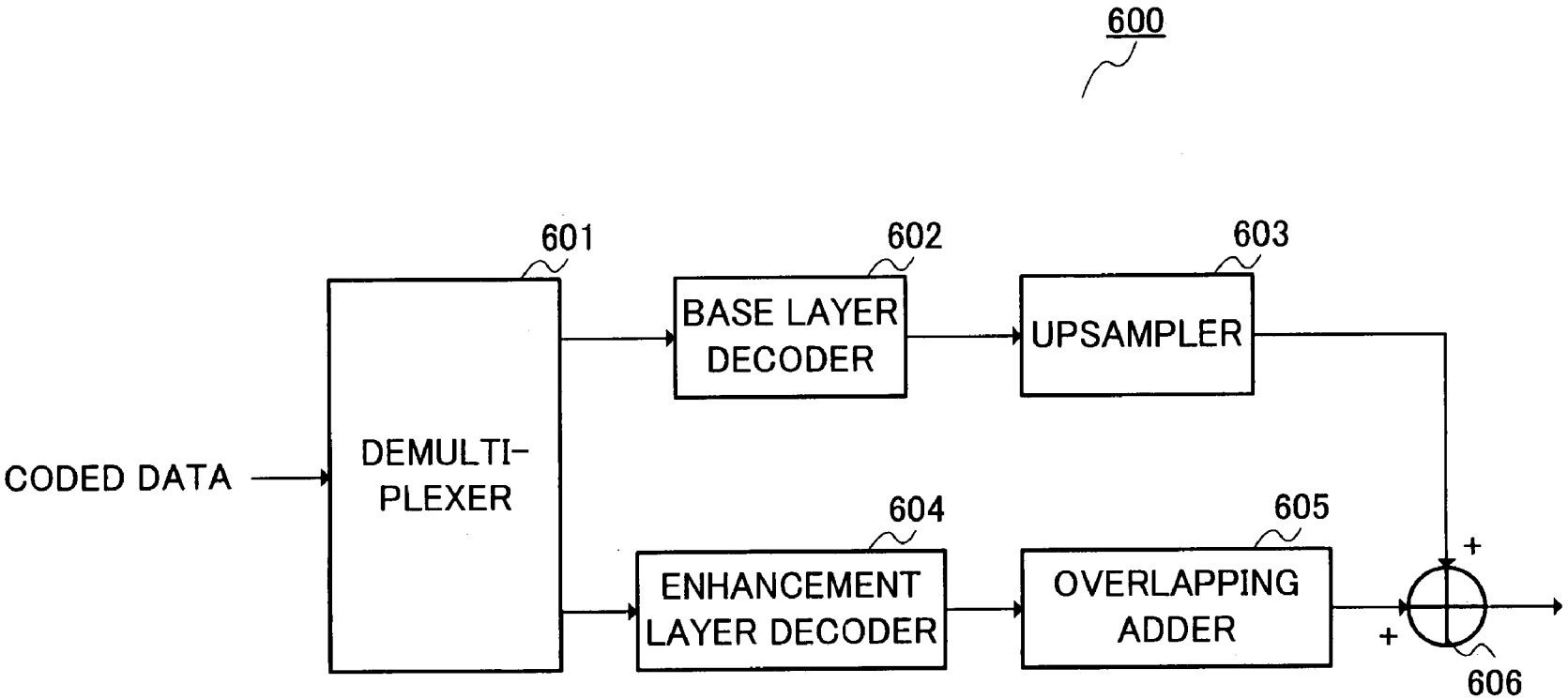
FIG. 8 illustrates a block diagram showing the configuration of an acoustic decoding apparatus according to Embodiment 1 of the present invention.

Next, the acoustic decoding apparatus which carries out the above described decoding will be explained. FIG. 8 is a block diagram showing the configuration of an acoustic decoding apparatus according to Embodiment 1 of the present invention. An acoustic decoding apparatus 600 in FIG. 8 is mainly constructed of a demultiplexer 601, a base layer decoder 602, an upsampler 603, an enhancement layer decoder 604, an overlapping adder 605 and an adder 606.

The demultiplexer 601 separates a code coded by the acoustic coding apparatus 100 into a first coded code for the base layer and a second coded code for the enhancement layer, outputs the first coded code to the base layer decoder 602 and outputs the second coded code to the enhancement layer decoder 604.

The base layer decoder 602 decodes the first coded code to obtain a decoded signal having a sampling rate 2*FL. The base layer decoder 602 outputs the decoded signal to the upsampler 603. The upsampler 603 converts the decoded signal of the sampling rate 2*FL to a decoded signal having a sampling rate 2*FH and outputs the converted signal to the adder 606.

The enhancement layer decoder 604 decodes the second coded code to obtain a decoded signal having the sampling rate 2*FH. This second coded code is the code obtained at the acoustic coding apparatus 100 by coding the input signal in units of enhancement frames having a shorter time length than that of the base frame. Then, the enhancement layer decoder 604 outputs this decoded signal to the overlapping adder 605.

The overlapping adder 605 overlaps the decoded signals in units of enhancement frames decoded by the enhancement layer decoder 604 and outputs the overlapped decoded signals to the adder 606. More specifically, the overlapping adder 605 multiplies the decoded signal by a window function for synthesis, overlaps the decoded signal with the signal in the time domain decoded in the preceding frame by half the synthesis frame length and adds up these signals to generate an output signal.

The adder 606 adds up the decoded signal in the base layer upsampled by the upsampler 603 and the decoded signal in the enhancement layer overlapped by the overlapping adder 605 and outputs the resulting signal.

Thus, according to the acoustic coding apparatus and acoustic decoding apparatus of this embodiment, the acoustic coding apparatus side divides a residual signal in units of the enhancement frame having a shorter time length than that of the base frame and encodes the divided residual signal, while the acoustic decoding apparatus side decodes the residual signal coded in units of the enhancement frame having a shorter time length than that of this base frame, overlaps portions having an overlapping time zone, and it is thereby possible to shorten the time length of the enhancement frame which may cause delays during decoding and shorten delays in speech decoding.

Embodiment 2

Figure 9:
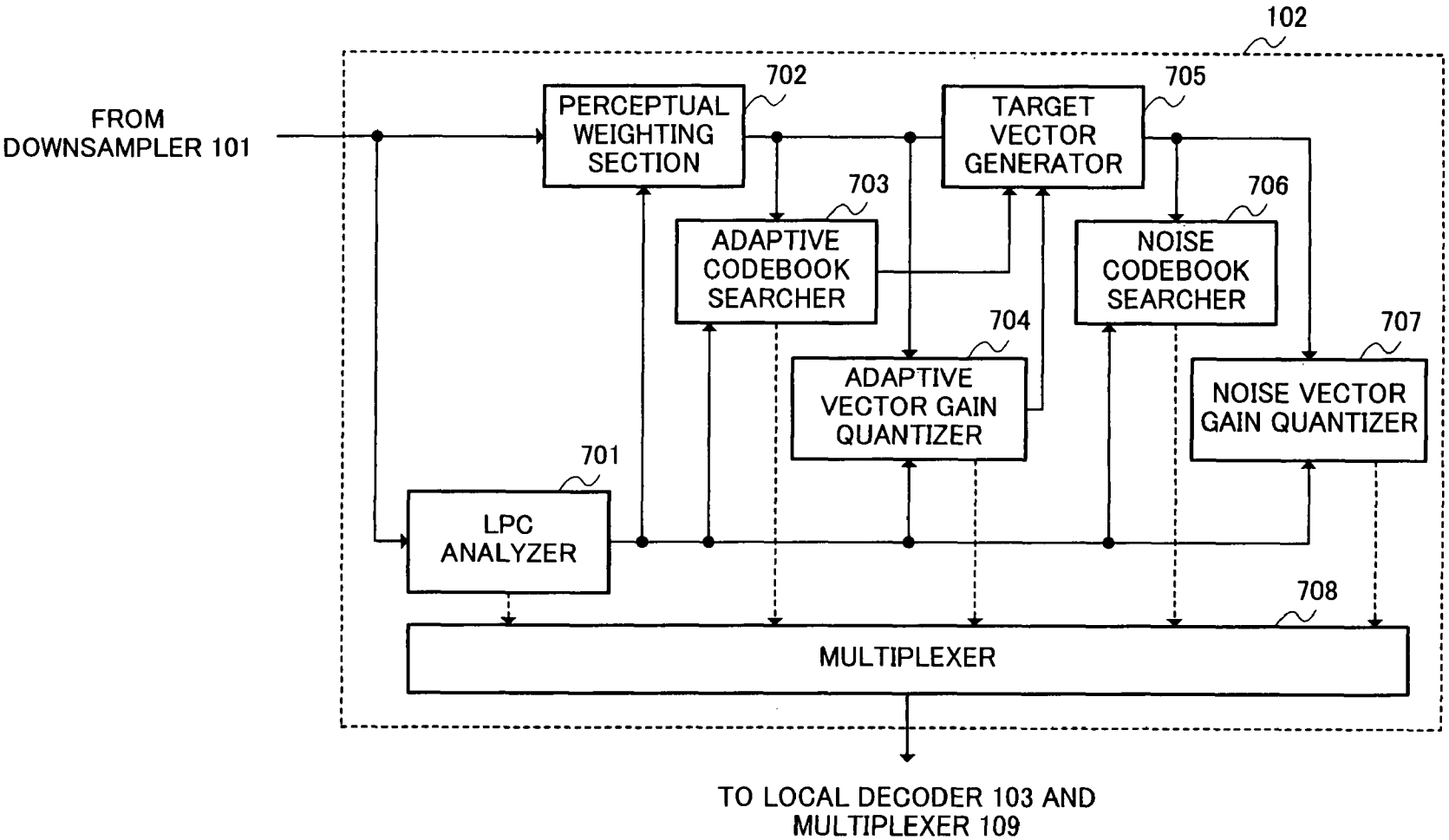
FIG. 9 is a block diagram showing an example of the internal configuration of a base layer coder according to Embodiment 2 of the present invention.

This embodiment will describe an example where CELP coding is used for coding of the base layer. FIG. 9 is a block diagram showing an example of the internal configuration of a base layer coder according to Embodiment 2 of the present invention. FIG. 9 shows the internal configuration of the base layer coder 102 in FIG. 3. The base layer coder 102 in FIG. 9 is mainly constructed of an LPC analyzer 701, a perceptual weighting section 702, an adaptive codebook searcher 703, an adaptive vector gain quantizer 704, a target vector generator 705, a noise codebook searcher 706, a noise vector gain quantizer 707 and a multiplexer 708.

The LPC analyzer 701 calculates LPC coefficients of an input signal of a sampling rate 2*FL and converts these LPC coefficients to a parameter set suitable for quantization such as LSP coefficients and quantizes the parameter set. Then, the LPC analyzer 701 outputs the coded code obtained by this quantization to the multiplexer 708.

Furthermore, the LPC analyzer 701 calculates the quantized LSP coefficients from the coded code, converts the LSP coefficients to LPC coefficients and outputs the quantized LPC coefficient to the adaptive codebook searcher 703, adaptive vector gain quantizer 704, noise codebook searcher 706 and noise vector gain quantizer 707. Furthermore, the LPC analyzer 701 outputs the LPC coefficients before quantization to the perceptual weighting section 702.

The perceptual weighting section 702 assigns a weight to the input signal output from the downsampler 101 based on both of the quantized and the non-quantized LPC coefficients obtained by the LPC analyzer 701. This is intended to perform spectral shaping so that the spectrum of quantization distortion is masked by a spectral envelope of the input signal.

The adaptive codebook searcher 703 searches for an adaptive codebook using the perceptual weighted input signal as a target signal. The signal obtained by repeating a past excitation string at pitch periods is called an "adaptive vector" and an adaptive codebook is constructed of adaptive vectors generated at pitch periods within a predetermined range.

When it is assumed that the perceptual weighted input signal is t(n), a signal obtained by convoluting an impulse response of a synthesis filter made up of LPC coefficients into an adaptive vector having a pitch period i is $p_i(n)$, the adaptive codebook searcher 703 outputs the pitch period i of the adaptive vector which minimizes an evaluation function D in Expression (1) as a parameter to the multiplexer 708.

$$D = \sum_{n=0}^{N-1} t^2(n) - \frac{\left(\sum_{n=0}^{N-1} t(n)p_i(n)\right)^2}{\sum_{n=0}^{N-1} p_i^2(n)} \tag{1}$$

where N denotes a vector length. The first term in Expression (1) is independent of the pitch period i, and therefore the adaptive codebook searcher 703 calculates only the second term.

The adaptive vector gain quantizer 704 quantizes the adaptive vector gain by which the adaptive vector is multiplied. The adaptive vector gain β is expressed by the following Expression (2) and the adaptive vector gain quantizer 704 scalar-quantizes this adaptive vector gain β and outputs the code obtained by the quantization to the multiplexer 708.

$$\beta = \frac{\sum_{n=0}^{N-1} t(n)p_i(n)}{\sum_{n=0}^{N-1} p_i^2(n)} \tag{2}$$

The target vector generator 705 subtracts the influence of the adaptive vector from the input signal, generates target vectors to be used in the noise codebook searcher 706 and noise vector gain quantizer 707 and outputs the target vectors. In the target vector generator 705, if it is assumed that $p_i(n)$ is a signal obtained by convoluting an impulse response of a synthesis filter into an adaptive vector when an evaluation function D expressed by Expression 1 is a minimum and $\beta_q$ is a quantized value when the adaptive vector β expressed by Expression 2 is scalar-quantized, the target vector $t_2$ (n) is expressed by Expression (3) below:

$$t_2(n)=t(n)-\beta_q \cdot p_i(n) \tag{3}$$

The noise codebook searcher 706 searches for a noise codebook using the target vector $t_2(n)$ and the quantized LPC coefficients. For example, a random noise or a signal learned using a large speech database can be used for a noise codebook in the noise codebook searcher 706. Furthermore, the noise codebook provided for the noise codebook searcher 706 can be expressed by a vector having a predetermined very small number of pulses of amplitude 1 like an algebraic codebook. This algebraic codebook is characterized by the ability to determine an optimum combination of pulse positions and pulse signs (polarities) by a small amount of calculation.

When it is assumed that the target vector is $t_2(n)$ and a signal obtained by convoluting an impulse response of a synthesis filter into the noise vector corresponding to code j is $c_j(n)$, the noise codebook searcher 706 outputs the index j of the noise vector that minimizes the evaluation function D of Expression (4) below to the multiplexer 708.

$$D = \sum_{n=0}^{N-1} t_2^2(n) - \frac{\left(\sum_{n=0}^{N-1} t_2(n)c_j(n)\right)^2}{\sum_{n=0}^{N-1} c_j^2(n)} \tag{4}$$

The noise vector gain quantizer 707 quantizes the noise vector gain by which the noise vector is multiplied. The noise vector gain quantizer 707 calculates a noise vector gain γ using Expression (5) shown below and scalar-quantizes this noise vector gain γ and outputs to the multiplexer 708.

$$\gamma = \frac{\sum_{n=0}^{N-1} t_2(n)c_j(n)}{\sum_{n=0}^{N-1} c_j^2(n)} \tag{5}$$

The multiplexer 708 multiplexes the coded codes of the quantized LPC coefficients, adaptive vector, adaptive vector gain, noise vector, and noise vector gain, and it outputs the multiplexing result to the local decoder 103 and multiplexer 109.

Figure 10:
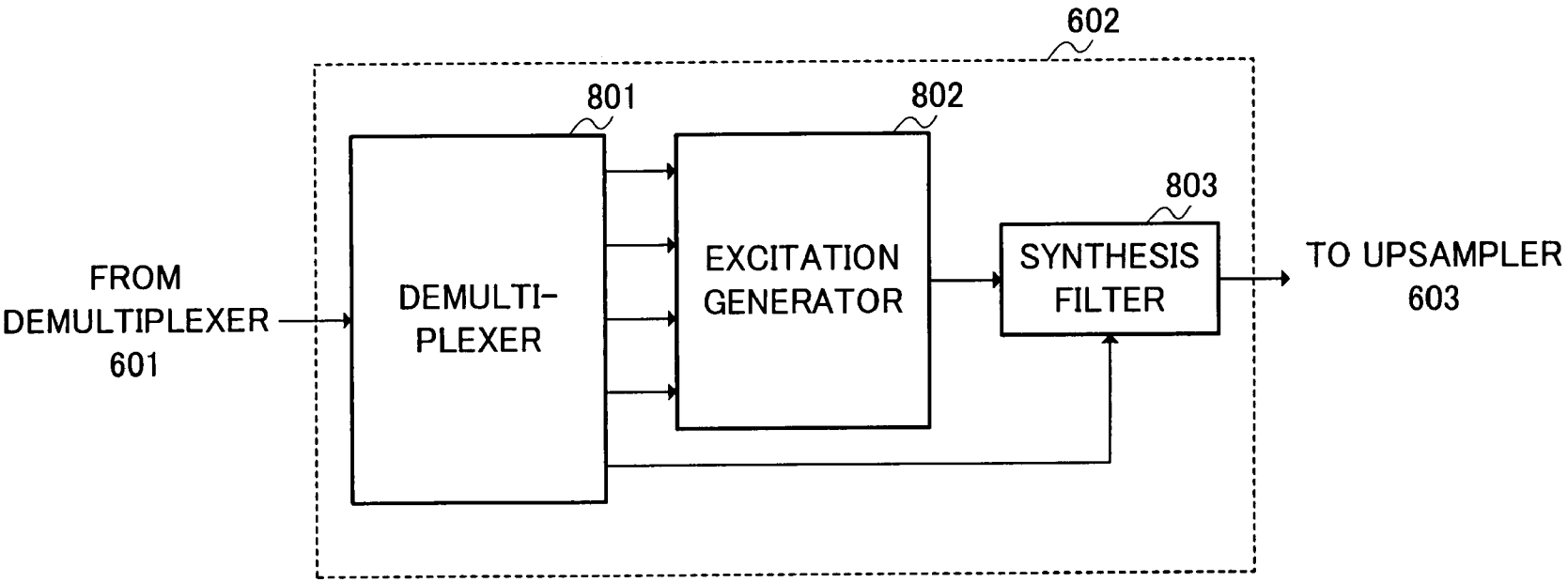
FIG. 10 is a block diagram showing an example of the internal configuration of a base layer decoder according to Embodiment 2 of the present invention.

Next, the decoding side will be explained. FIG. 10 is a block diagram showing an example of the internal configuration of a base layer decoder according to Embodiment 2 of the present invention. FIG. 10 illustrates the internal configuration of the base layer decoder 602 in FIG. 8. The base layer decoder 602 in FIG. 10 is mainly constructed of a demultiplexer 801, excitation generator 802 and a synthesis filter 803.

The demultiplexer 801 separates the first coded code output from the demultiplexer 601 into the coded code of the quantized LPC coefficients, adaptive vector, adaptive vector gain, noise vector and noise vector gain, and it outputs the coded code of the adaptive vector, adaptive vector gain, noise vector and the noise vector gain to the excitation generator 802. Likewise, the demultiplexer 801 outputs the coded code of the quantized LPC coefficients to the synthesis filter 803.

The excitation generator 802 decodes the coded code of the adaptive vector, adaptive vector gain, noise vector and the noise vector gain, and it generates an excitation vector ex(n) using Expression (6) shown below:

$$ex(n)=\beta_q \cdot q(n)+\gamma_q \cdot c(n) \tag{6}$$

where q(n) denotes the adaptive vector, $\beta_q$ denotes the adaptive vector gain, c(n) denotes the noise vector and $\gamma_q$ denotes the noise vector gain.

The synthesis filter 803 decodes the quantized LPC coefficients from the coded code of the LPC coefficient and generates a synthesis signal syn(n) using Expression (7) shown below:

$$syn(n) = ex(n) + \sum_{i=1}^{NP} \alpha_q(i) \cdot syn(n-i) \tag{7}$$

where $\alpha_q$ denotes the decoded LPC coefficients and NP denotes the order of the LPC coefficients. The synthesis filter 803 outputs the decoded signal syn(n) to the upsampler 603.

Thus, according to the acoustic coding apparatus and acoustic decoding apparatus of this embodiment, the transmitting side encodes an input signal by applying CELP coding to the base layer and the receiving side applies the decoding method of the CELP coding to the base layer, and it is thereby possible to realize a high quality base layer at a low bit rate.

Figure 11:
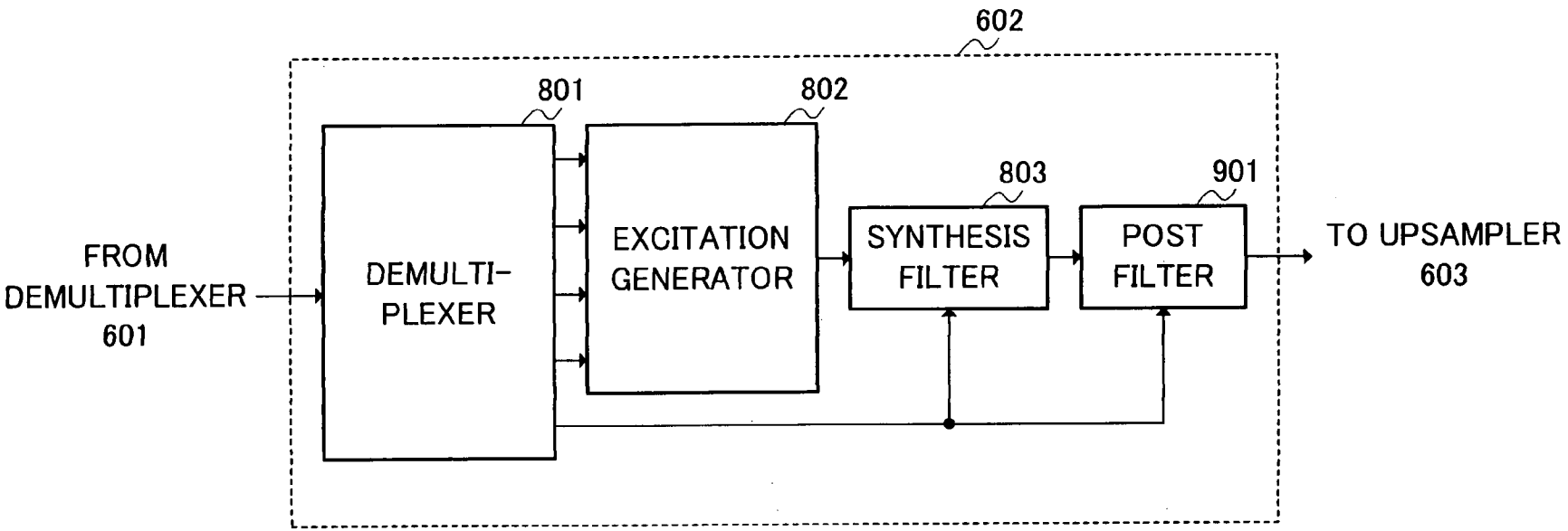
FIG. 11 is a block diagram showing another example of the internal configuration of the base layer decoder according to Embodiment 2 of the present invention.

The speech coding apparatus of this embodiment can also adopt a configuration with a post filter followed by the synthesis filter 803 to improve subjective quality. FIG. 11 is a block diagram showing an example of the internal configuration of the base layer decoder according to Embodiment 2 of the present invention. However, the same components as those in FIG. 10 are assigned the same reference numerals as those in FIG. 10 and detailed explanations thereof will be omitted.

For the post filter 901, various configurations may be adopted to improve subjective quality. One typical method is a method using a formant enhanced filter made up of an LPC coefficient obtained by being decoded by the demultiplexer 801. A formant emphasis filter $H_f(z)$ is expressed by Expression (8) shown below:

$$H_f(z) = \frac{A(z/\gamma_n)}{A(z/\gamma_d)} \cdot (1 - \mu z^{-1}) \tag{8}$$

where 1/A(z) denotes the synthesis filter made up of the decoded LPC coefficients and $\gamma_n$, $\gamma_d$ and $\mu$ denote constants which determine the filter characteristic.

Embodiment 3

Figure 12:
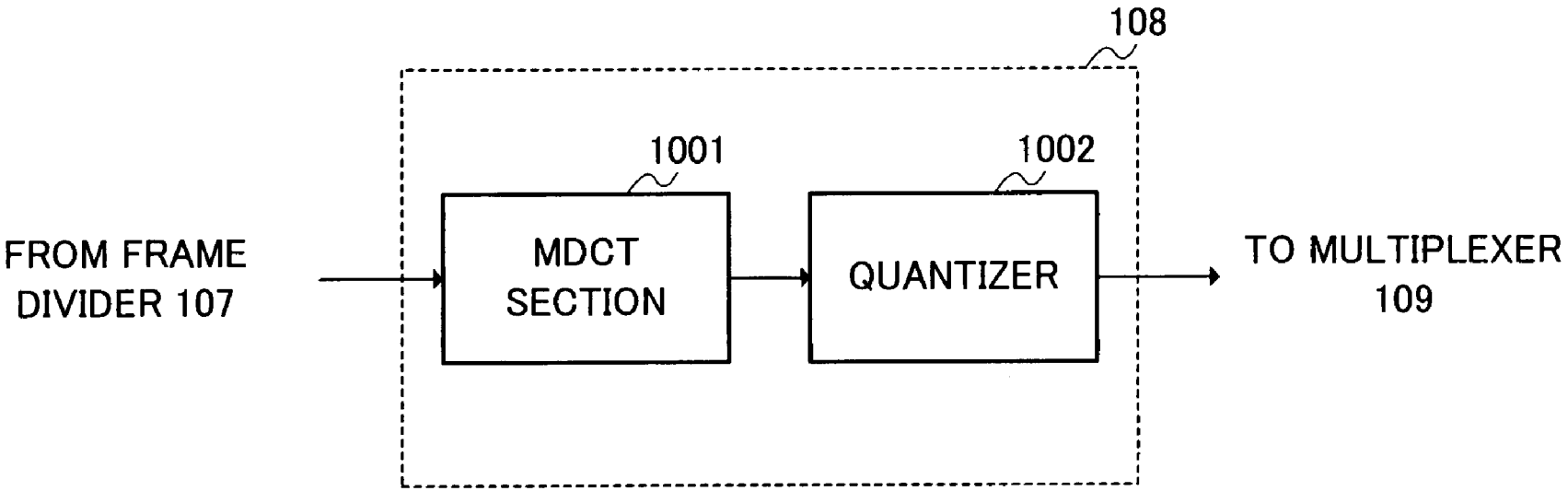
FIG. 12 is a block diagram showing an example of the internal configuration of an enhancement layer coder according to Embodiment 3 of the present invention.

This embodiment is characterized by the use of transform coding whereby an input signal of the enhancement layer is transformed into a coefficient of the frequency domain and then the transformed coefficients are encoded. The basic configuration of an enhancement layer coder 108 according to this embodiment will be explained using FIG. 12. FIG. 12 is a block diagram showing an example of the internal configuration of an enhancement layer coder according to Embodiment 3 of the present invention. FIG. 12 shows an example of the internal configuration of the enhancement layer coder 108 in FIG. 3. The enhancement layer coder 108 in FIG. 12 is mainly constructed of an MDCT section 1001 and a quantizer 1002.

The MDCT section 1001 MDCT-transforms (modified discrete cosine transform) an input signal output from the frame divider 107 to obtain MDCT coefficients. An MDCT transform completely overlaps successive analysis frames by half the analysis frame length. And the orthogonal bases of the MDCT consist of "odd functions" for the first half of the analysis frame and "even functions" for the second half. In the synthesis process, the MDCT transform does not generate any frame boundary distortion because it overlaps and adds up inverse-transformed waveforms. When an MDCT is performed, the input signal is multiplied by a window function such as sine window. When a set of MDCT coefficients is assumed to be X(n), the MDCT coefficients can be calculated by Expression (9) shown below:

$$X(m) = \sqrt{\frac{1}{N}} \sum_{n=0}^{2N-1} x(n)\cos\left\{\frac{(2n+1+N)\cdot(2m+1)\pi}{4N}\right\} \tag{9}$$

where X(n) denotes a signal obtained by multiplying the input signal by the window function.

The quantizer 1002 quantizes the MDCT coefficients calculated by the MDCT section 1001. More specifically, the quantizer 1002 scalar-quantizes the MDCT coefficients Or a vector is formed by plural MDCT coefficients and vector-quantized. Especially when scalar quantization is applied, the above described quantization method tends to increase the bit rate in order to obtain sufficient quality. For this reason, this quantization method is effective when it is possible to allocate sufficient bits to the enhancement layer. Then, the quantizer 1002 outputs codes obtained by quantizing the MDCT coefficients to the multiplexer 109.

Figure 13:
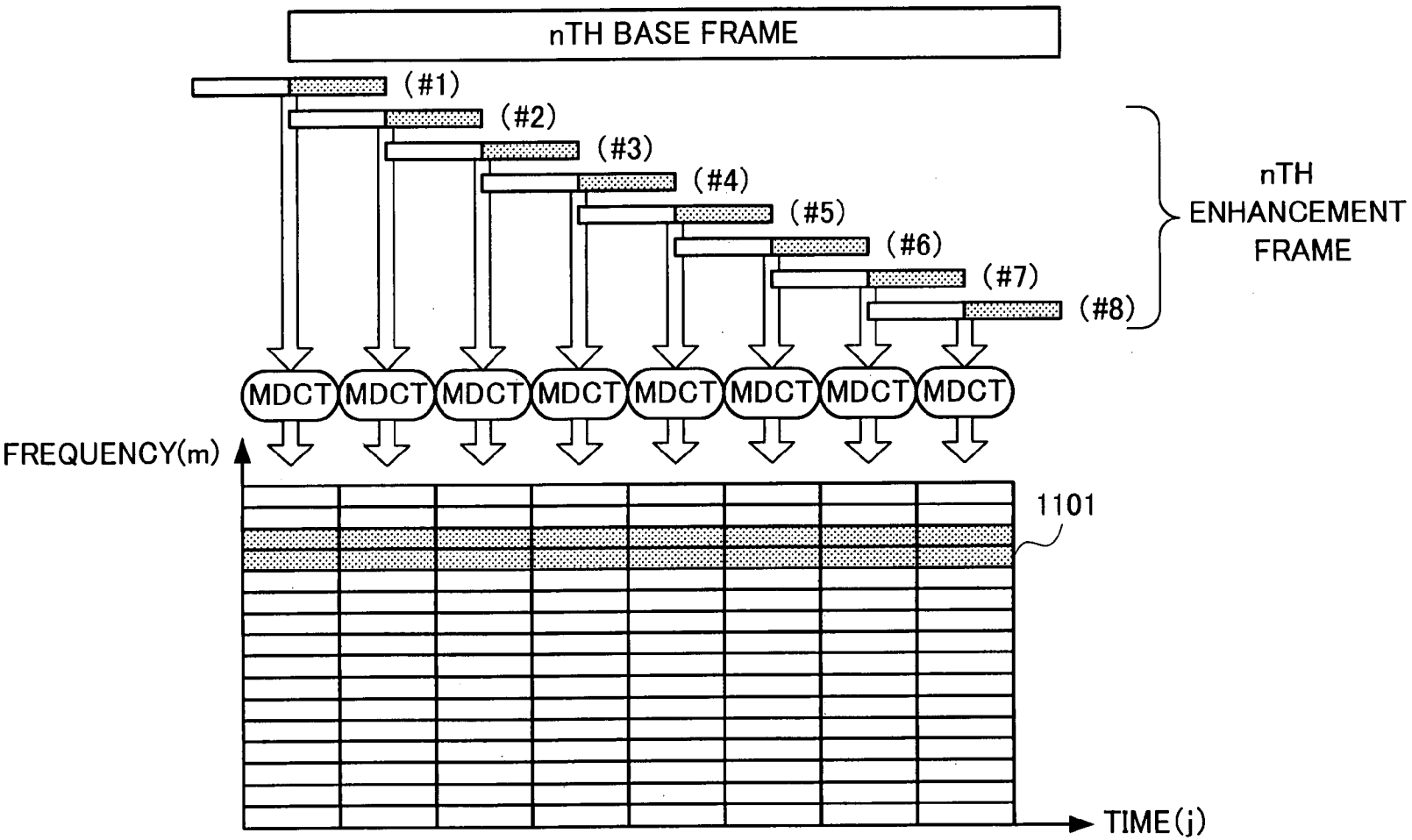
FIG. 13 illustrates an example of the arrangement of MDCT coefficients.

Next, a method of efficiently quantizing the MDCT coefficients by mitigating an increase in the bit rate will be explained. FIG. 13 shows an example of the arrangement of the MDCT coefficients. In FIG. 13, the horizontal axis shows a time and the vertical axis shows a frequency.

The MDCT coefficients to be coded in the enhancement layer can be expressed by a two-dimensional matrix with the time direction and frequency direction as shown in FIG. 13. In this embodiment, eight enhancement frames are set for one base frame, and therefore the horizontal axis becomes eight-dimensional and the vertical axis has the number of dimensions that matches the length of the enhancement frame. In FIG. 13, the vertical axis is expressed with 16 dimensions, but the number of dimensions is not limited to this.

Many bits are necessary for quantization to obtain sufficiently high SNRs for all the MDCT coefficients expressed in FIG. 13. To avoid this problem, the acoustic coding apparatus of this embodiment quantizes only the MDCT coefficients included in a predetermined band and sends no information on other MDCT coefficients. That is, the MDCT coefficients in a shaded area 1101 in FIG. 13 are quantized and other MDCT coefficients are not quantized.

This quantization method is based on the concept that the band (0 to FL) to be encoded by the base layer has already been coded with sufficient quality in the base layer and has a sufficient amount of information, and therefore it is only necessary to code other bands (e.g., FL to FH) in the enhancement layer. Or this quantization method is based on the concept that coding distortion tends to increase in the high frequency section of the band to be coded by the base layer, and therefore it is only necessary to encode the high frequency section of the band to be coded by the base layer and the band not to be coded by the base layer.

Thus, by regarding only the domain that cannot be covered by coding of the base layer or the domain that cannot be covered by coding of the base layer and a domain including part of the band covered by the coding of the base layer as the coding targets, it is possible to reduce signals to be coded and achieve the efficient quantization of MDCT coefficients while mitigating an increase in the bit rate.

Figure 14:
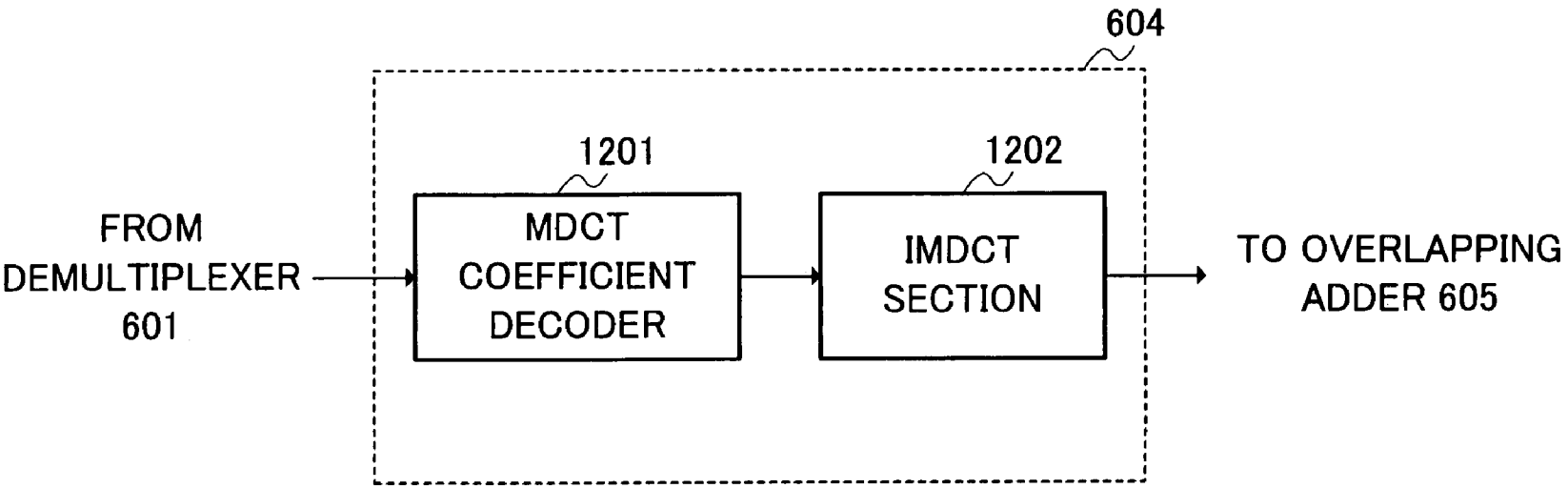
FIG. 14 is a block diagram showing an example of the internal configuration of an enhancement layer decoder according to Embodiment 3 of the present invention.

Next, the decoding side will be explained. Hereafter, a case where an inverse modified discrete cosine transform (IMDCT) is used as the method of a transform from the frequency domain to time domain will be explained. FIG. 14 is a block diagram showing an example of the internal configuration of an enhancement layer decoder according to Embodiment 3 of the present invention. FIG. 14 shows an example of the internal configuration of the enhancement layer decoder 604 in FIG. 8. The enhancement layer decoder 604 in FIG. 14 is mainly constructed of an MDCT coefficient decoder 1201 and an IMDCT section 1202.

The MDCT coefficient decoder 1201 decodes the quantized MDCT coefficients from the second coded code output from the demultiplexer 601. The IMDCT section 1202 applies an IMDCT to the MDCT coefficients output from the MDCT coefficient decoder 1201, generates time domain signals and outputs the time domain signals to the overlapping adder 605.

Thus, according to the acoustic coding apparatus and acoustic decoding apparatus of this embodiment, a difference signal is transformed from a time domain to a frequency domain, encodes the frequency domain of the transformed signal in the enhancement layer which cannot be covered by the base layer encoding, and can thereby achieve the effecient coding for a signal having a large spectral variation such as music.

The band to be coded by the enhancement layer need not be fixed to FL to FH. The band to be coded in the enhancement layer changes depending on the characteristic of the coding method of the base layer and amount of information included in the high frequency band of the input signal. Therefore, as explained in Embodiment 2, in the case where CELP coding for wideband signals is used for the base layer and the input signal is speech, it is recommendable to set the band to be encoded by the enhancement layer to 6 kHz to 9 kHz.

Embodiment 4

A human perceptual characteristic has a masking effect that when a certain signal is given, signals having frequencies close to the frequency of the signal cannot be heard. A feature of this embodiment is to find the perceptual masking based on the input signal and carry out coding of the enhancement layer using the perceptual masking.

Figure 15:
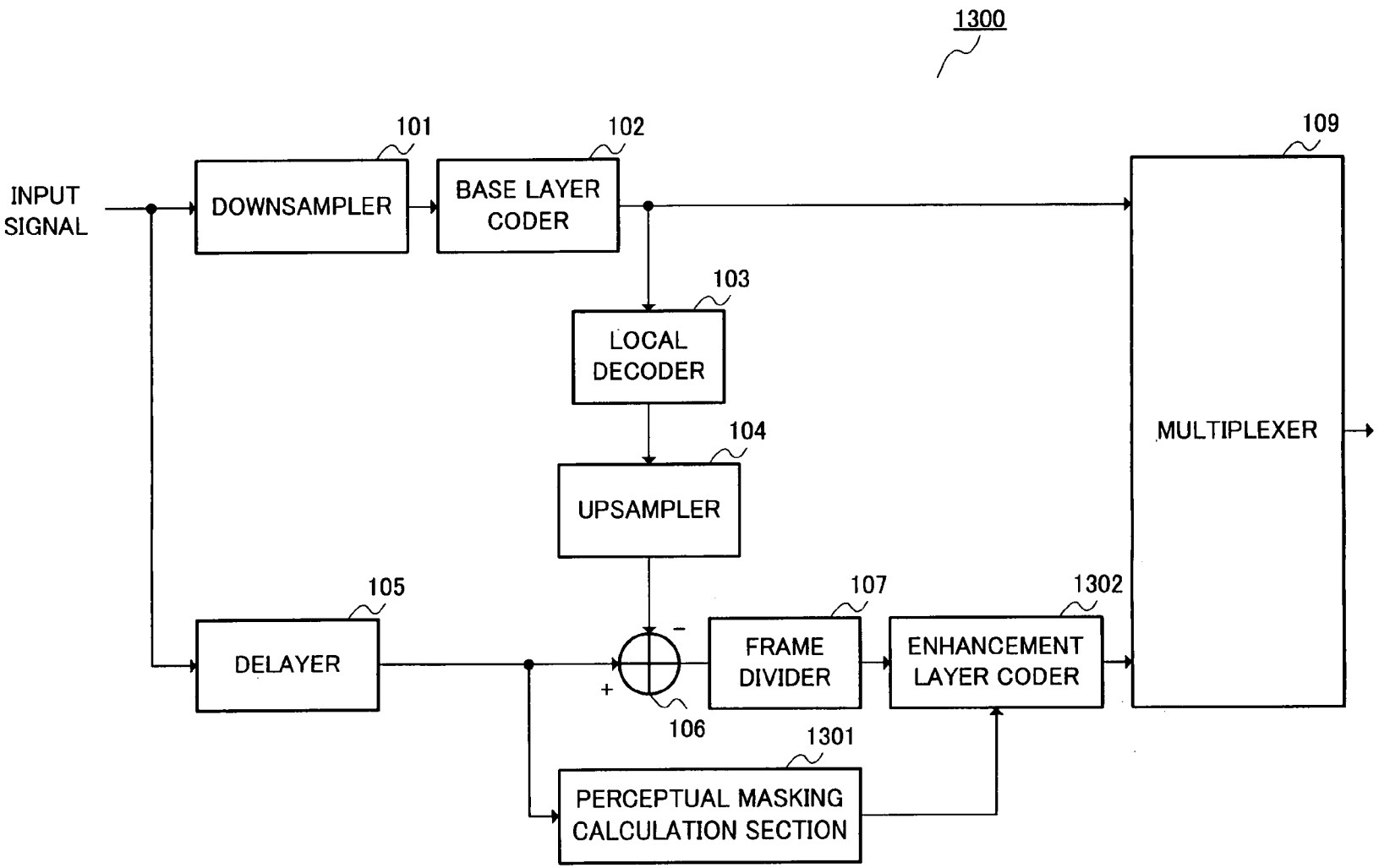
FIG. 15 is a block diagram showing the configuration of an acoustic coding apparatus according to Embodiment 4 of the present invention.

FIG. 15 is a block diagram showing the configuration of an acoustic coding apparatus according to Embodiment 4 of the present invention. However, the same components as those in FIG. 3 are assigned the same reference numerals as those in FIG. 3 and detailed explanations thereof will be omitted. An acoustic coding apparatus 1300 in FIG. 15 is provided with a perceptual masking calculation section 1301 and an enhancement layer coder 1302, and is different from the acoustic coding apparatus in FIG. 3 in that it calculates the perceptual masking from the spectrum of the input signal and quantizes MDCT coefficients so that quantization distortion falls below this masking value.

A delayer 105 delays the input signal by a predetermined time and outputs the delayed input signal to a subtractor 106 and perceptual masking calculation section 1301. The perceptual masking calculation section 1301 calculates perceptual masking indicating the magnitude of a spectrum which cannot be perceived by the human auditory sense and outputs the perceptual masking to the enhancement layer coder 1302. The enhancement layer coder 1302 encodes a difference signal of a domain having a spectrum exceeding the perceptual masking and outputs the coded code of the difference signal to a multiplexer 109.

Figure 16:
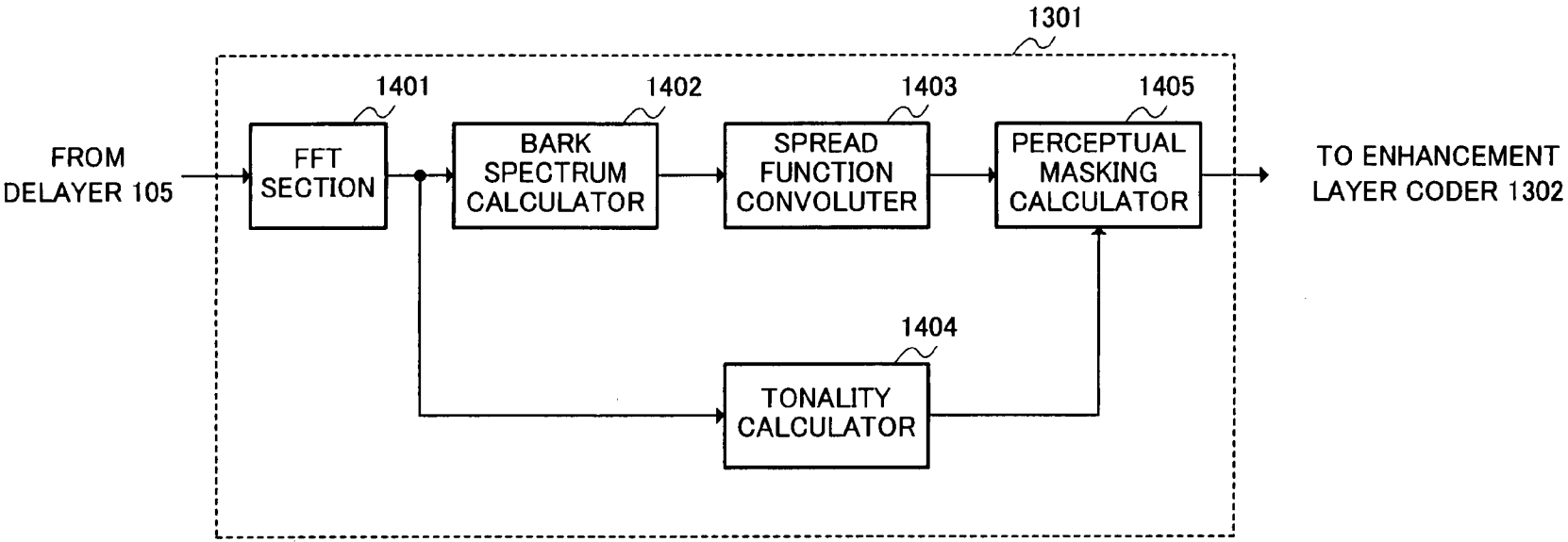
FIG. 16 is a block diagram showing an example of the internal configuration of a perceptual masking calculation section in the above embodiment.

Next, details of the perceptual masking calculation section 1301 will be explained. FIG. 16 is a block diagram showing an example of the internal configuration of the perceptual masking calculation section of this embodiment. The perceptual masking calculation section 1301 in FIG. 16 is mainly constructed of an FFT section 1401, a bark spectrum calculator 1402, a spread function convoluter 1403, a tonality calculator 1404 and a perceptual masking calculator 1405.

In FIG. 16, the FFT section 1401 Fourier-transforms the input signal output from the delayer 105 and calculates Fourier coefficients {Re(m),Im(m)}. Here, m denotes a frequency.

The bark spectrum calculator 1402 calculates a bark spectrum B(k) using Expression (10) shown below:

$$B(k) = \sum_{m=fl(k)}^{fh(k)} P(m) \tag{10}$$

where P(m) denotes a power spectrum which is calculated by Expression (11) shown below:

$$P(m)=Re^2(m)+Im^2(m) \tag{11}$$

where Re(m) and Im(m) denote the real part and imaginary part of a complex spectrum with frequency m, respectively. Furthermore, k corresponds to the number of the bark spectrum, FL(k) and FH(k) denote the minimum frequency (Hz) and maximum frequency (Hz) of the kth bark spectrum, respectively. Bark spectrum B(k) denotes the intensity of a spectrum when the spectrum is divided into bands at regular intervals on the bark scale. When a hertz scale is expressed as f and bark scale is expressed as B, the relationship between the hertz scale and the bark scale is expressed by Expression (12) shown below:

$$B = 13\ \tan^{-1}(0.76f) + 3.5\ \tan^{-1}\left(\frac{f}{7.5}\right) \tag{12}$$

The spread function convoluter 1403 convolutes a spread function SF(k) into the bark spectrum B(k) to calculate C(k).

$$C(k)=B(k)*SF(k) \tag{13}$$

The tonality calculator 1404 calculates spectrum flatness SFM(k) of each bark spectrum from the power spectrum P(m) using Expression (14) shown below:

$$SFM(k) = \frac{\mu g(k)}{\mu a(k)} \tag{14}$$

where μg(k) denotes a geometric mean of the kth bark spectrum and μa(k) denotes an arithmetic mean of the kth bark spectrum. The tonality calculator 1404 calculates atonality coefficient α(k) from a decibel value SFM dB(k) of spectrum flatness SFM(k) using Expression (15) shown below:

$$\alpha(k) = \min\left(\frac{SFMdB(k)}{-60}, 1.0\right) \tag{15}$$

The perceptual masking calculator 1405 calculates an offset O(k) of each bark scale from the tonality coefficient α(k) calculated by the tonality calculator 1404 using Expression (16) shown below:

$$O(k)=\alpha(k)\cdot(14.5-k)+(1.0-\alpha(k))\cdot 5.5 \tag{16}$$

Then, the perceptual masking calculator 1405 subtracts the offset O(k) from the C(k) obtained by the spread function convoluter 1403 using Expression (17) shown below to calculate a perceptual masking T(k).

$$T(k)=\max(10^{\log_{10}(C(k))-(O(k)/10)}, T_q(k)) \tag{17}$$

where $T_q(k)$ denotes an absolute threshold. The absolute threshold denotes a minimum value of perceptual masking observed as the human perceptual characteristic. The perceptual masking calculator 1405 transforms the perceptual masking T(k) expressed on a bark scale into a hertz scale M (m) and outputs it to the enhancement layer coder 1302.

Figure 17:
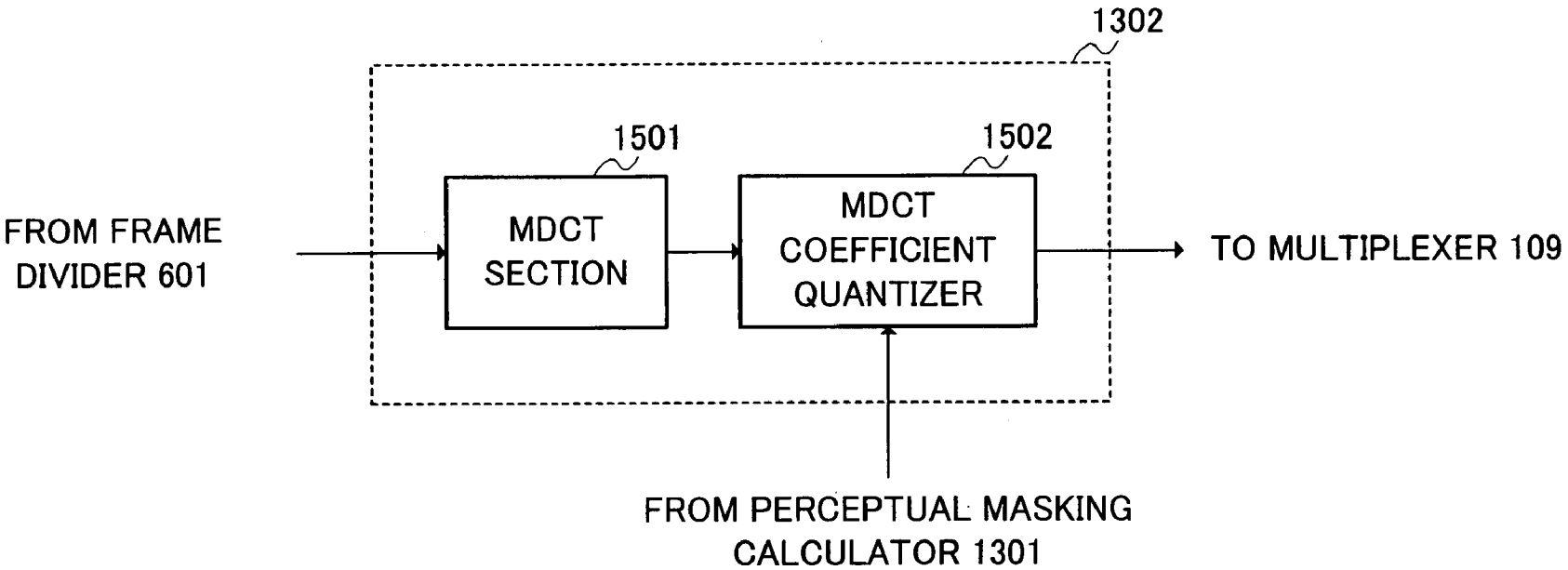
FIG. 17 a block diagram showing an example of the internal configuration of an enhancement layer coder in the above embodiment.

Using the perceptual masking M(m) obtained in this way, the enhancement layer coder 1302 encodes the MDCT coefficients. FIG. 17 is a block diagram showing an example of the internal configuration of an enhancement layer coder of this embodiment. The enhancement layer coder 1302 in FIG. 17 is mainly constructed of an MDCT section 1501 and an MDCT coefficients quantizer 1502.

The MDCT section 1501 multiplies the input signal output from the frame divider 107 by an analysis window, MDCT-transforms (modified discrete cosine transform) the input signal to obtain MDCT coefficients. The MDCT overlaps successive analysis by half the analysis frame length. And the orthogonal bases of the MDCT consists of odd functions for the first half of the analysis frame and even functions for the second half. In the synthesis process, the MDCT overlaps the inverse transformed waveforms and adds up the waveforms, and therefore no frame boundary distortion occurs. When an MDCT is performed, the input signal is multiplied by a window function such as sine window. When the MDCT coefficient is assumed to be X (n), the MDCT coefficients are calculated according to Expression (9).

The MDCT coefficient quantizer 1502 uses the perceptual masking output from the perceptual masking calculation section 1301 for the MDCT coefficients output from the MDCT section 1501 to classify the MDCT coefficients into coefficients to be quantized and coefficients not to be quantized and encodes only the coefficients to be quantized. More specifically, the MDCT coefficient quantizer 1502 compares the MDCT coefficients X(m) with the perceptual masking M(m) and ignores the MDCT coefficients X(m) having smaller intensity than M(m) and excludes them from the coding targets because such MDCT coefficients X(m) are not perceived by the human auditory sense due to a perceptual masking effect and quantizes only the MDCT coefficients having greater intensity than M(m). Then, the MDCT coefficient quantizer 1502 outputs the quantized MDCT coefficients to the multiplexer 109.

Thus, the acoustic coding apparatus of this embodiment calculates perceptual masking from the spectrum of the input signal taking advantage of the characteristic of the masking effect, carries out quantization during coding of the enhancement layer so that quantization distortion falls below this masking value, can thereby reduce the number of MDCT coefficients to be quantized without causing quality degradation and realize coding at a low bit rate and with high quality.

Figure 18:
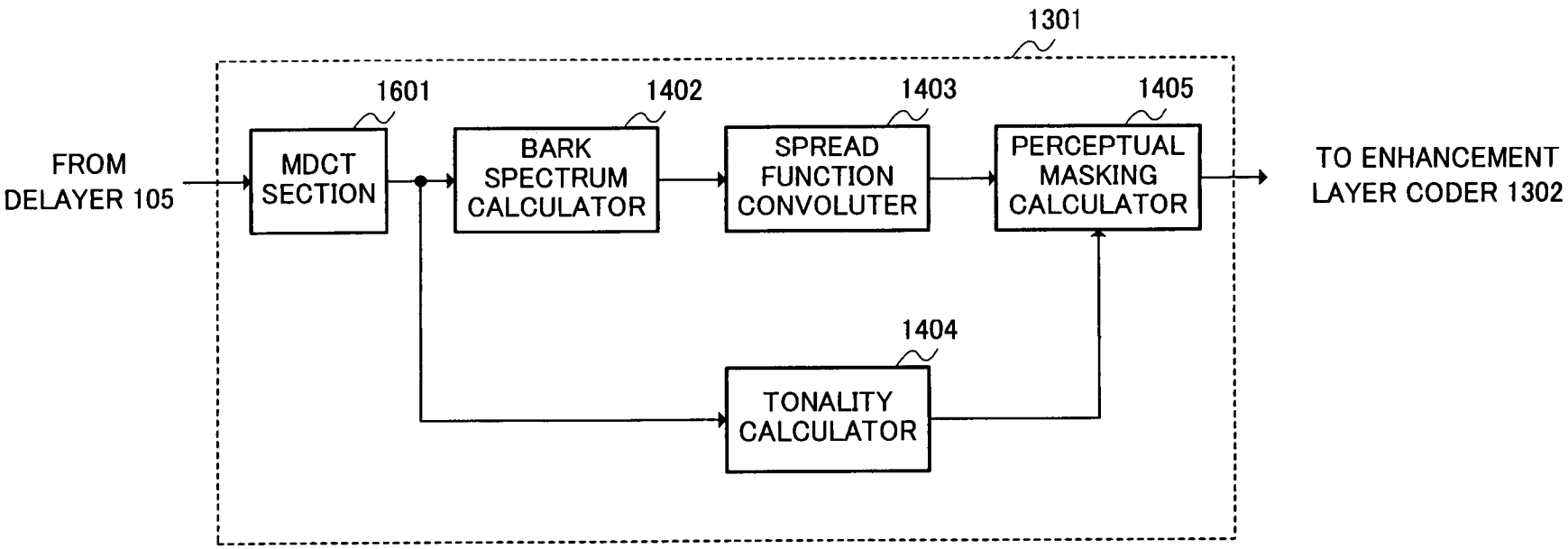
FIG. 18 is a block diagram showing an example of the internal configuration of a perceptual masking calculation section in the above embodiment.

The above embodiment has explained the method of calculating perceptual masking using an FFT, but it is also possible to calculate the perceptual masking using an MDCT instead of FFT. FIG. 18 is a block diagram showing an example of the internal configuration of a perceptual masking calculation section of this embodiment. However, the same components as those in FIG. 16 are assigned the same reference numerals as those in FIG. 16 and detailed explanations thereof will be omitted.

The MDCT section 1601 approximates a power spectrum P(m) using MDCT coefficients. More specifically, the MDCT section 1601 approximates P(m) using Expression (18) below:

$$P(m)=R^2(m) \tag{18}$$

where R(m) denotes an MDCT coefficient obtained by MDCT-transforming the input signal.

The bark spectrum calculator 1402 calculates a bark spectrum B(k) from P(m) approximated by the MDCT section 1601. From then on, perceptual masking is calculated according to the above described method.

Embodiment 5

This embodiment relates to the enhancement layer coder 1302 and a feature thereof is that it relates to a method of efficiently coding position information on MDCT coefficients when MDCT coefficients exceeding perceptual masking are quantization targets.

Figure 19:
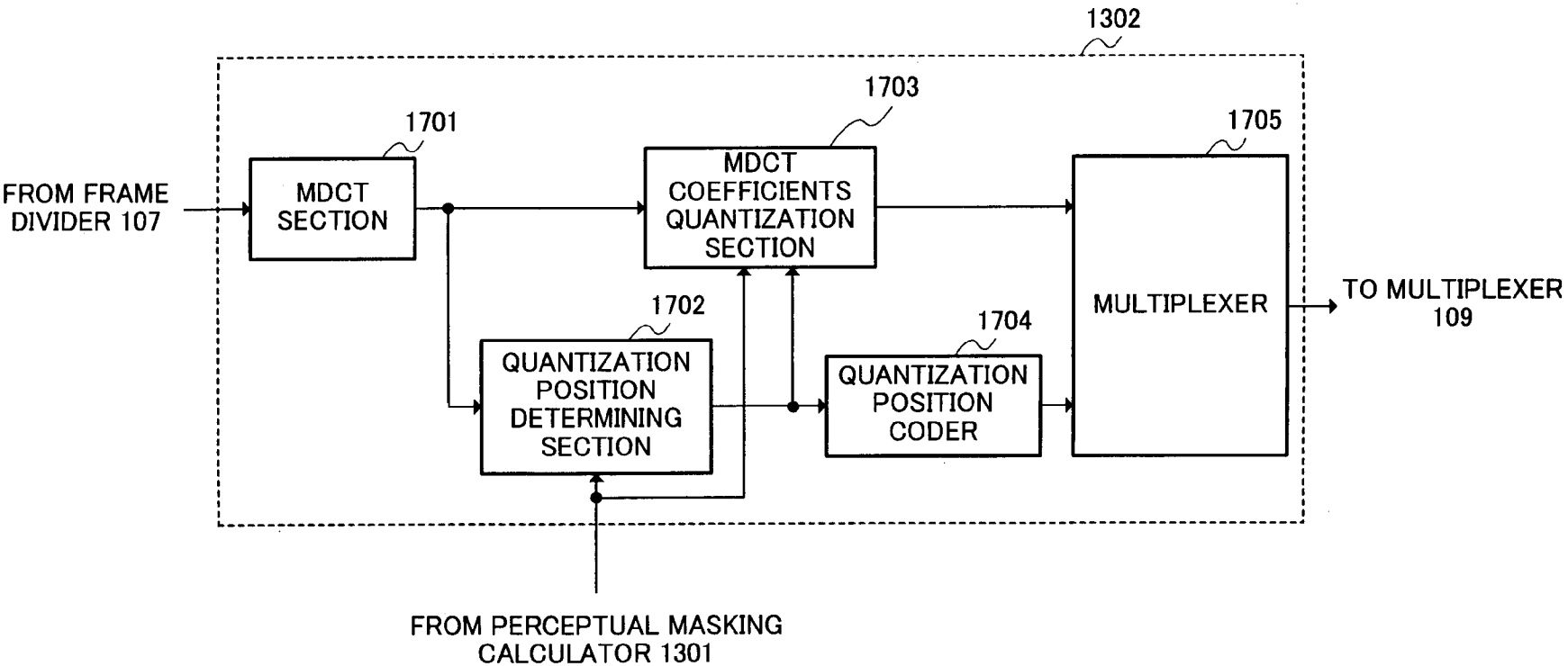
FIG. 19 is a block diagram showing an example of the internal configuration of an enhancement layer coder according to Embodiment 5 of the present invention.

FIG. 19 is a block diagram showing an example of the internal configuration of an enhancement layer coder according to Embodiment 5 of the present invention. FIG. 19 shows an example of the internal configuration of the enhancement layer coder 1302 in FIG. 15. The enhancement layer coder 1302 in FIG. 19 is mainly constructed of an MDCT section 1701, a quantization position determining section 1702, an MDCT coefficient quantizer 1703, a quantization position coder 1704 and a multiplexer 1705.

The MDCT section 1701 multiplies the input signal output from the frame divider 107 by an analysis window and then MDCT-transforms (modified discrete cosine transform) the input signal to obtain MDCT coefficients. The MDCT transform is performed by overlapping successive frames by half the analysis frame length and uses orthogonal bases of odd functions for the first half of the analysis frame and even functions for the second half. In the synthesis process, the MDCT transform overlaps the inverse transformed waveforms and adds up the waveforms, and therefore no frame boundary distortion occurs. When the MDCT is performed, the input signal is multiplied by a window function such as sine window. When MDCT coefficients are assumed to be X(n), the MDCT coefficients are calculated according to Expression (9).

Figure 20:
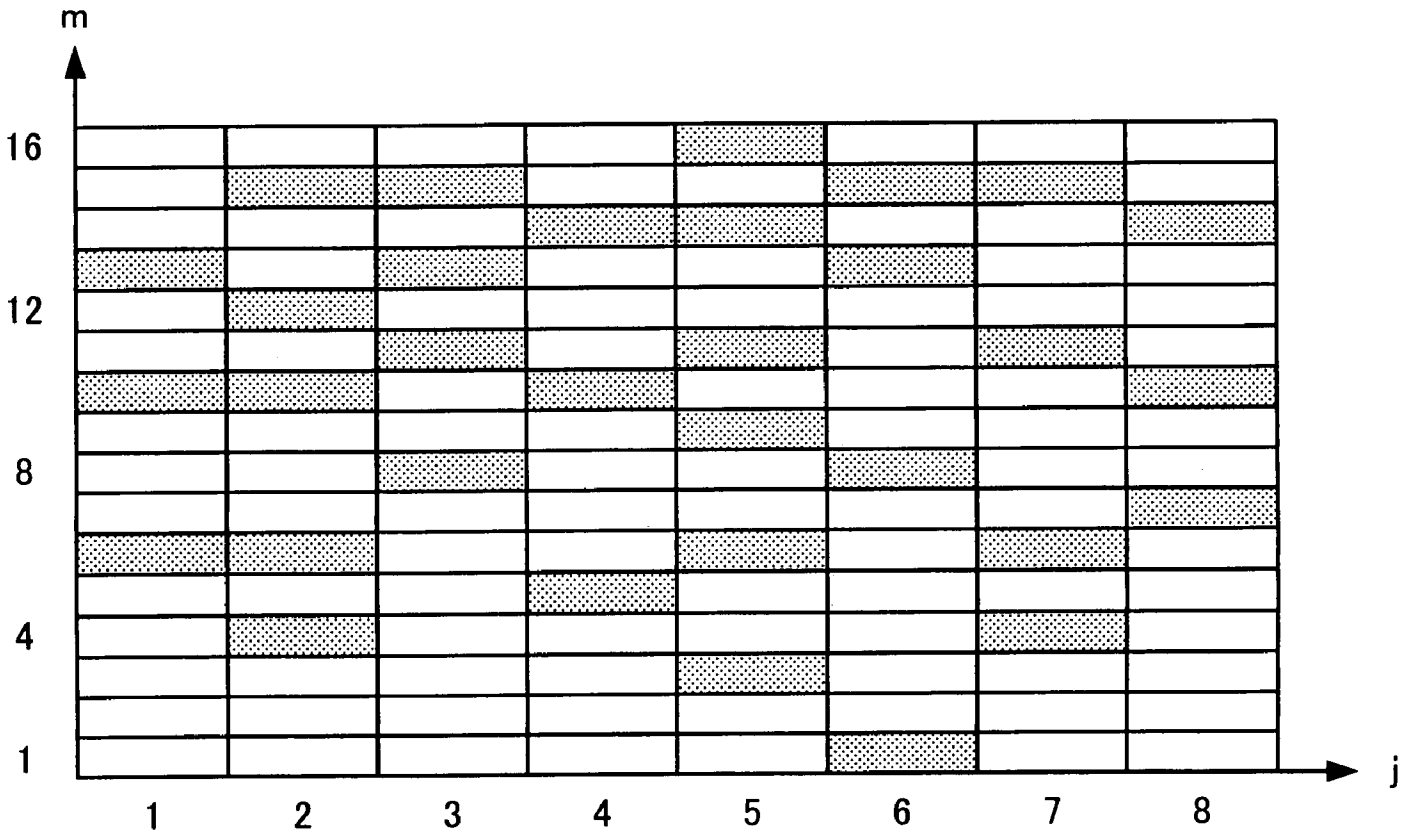
FIG. 20 illustrates an example of the arrangement of MDCT coefficients.

The MDCT coefficient calculated by the MDCT section 1701 is expressed as X(j,m). Here, j denotes the frame number of an enhancement frame and m denotes a frequency. This embodiment will explain a case where the time length of the enhancement frame is ⅛ of the time length of the base frame. FIG. 20 shows an example of the arrangement of MDCT coefficients. An MDCT coefficient X(j,m) can be expressed on a matrix whose horizontal axis shows a time and whose vertical axis shows a frequency as shown in FIG. 20. The MDCT section 1701 outputs the MDCT coefficient X(j,m) to the quantization position determining section 1702 and MDCT coefficients quantization section 1703.

The quantization position determining section 1702 compares the perceptual masking M(j,m) output from the perceptual masking calculation section 1301 with the MDCT coefficient X(j,m) output from the MDCT section 1701 and determines which positions of MDCT coefficients are to be quantized.

More specifically, when Expression (19) shown below is satisfied, the quantization position determining section 1702 quantizes X(j,m).

$$|X(j,m)|-M(j,m)>0 \tag{19}$$

Then, when Expression (20) is satisfied, the quantization position determining section 1702 does not quantize X(j,m)

$$|X(j,m)|-M(j,m)\leqq 0 \tag{20}$$

Then, the quantization position determining section 1702 outputs the position information on the MDCT coefficient X(j,m) to be quantized to the MDCT coefficients quantization section 1703 and quantization position coder 1704. Here, the position information indicates a combination of time j and frequency m.

In FIG. 20, the positions of the MDCT coefficients X(j,m) to be quantized determined by the quantization position determining section 1702 are expressed by shaded areas. In this example, the MDCT coefficients X(j,m) at positions (j,m) =(6,1), (5,3), . . . , (7,15), (5,16) are quantization targets.

Here, suppose the perceptual masking M(j,m) is calculated by being synchronized with the enhancement frame. However, because of restrictions on the amount of calculation, etc., it is also possible to calculate perceptual masking M(j,m) in synchronization with the base frame. In this case, compared to the case where perceptual masking is synchronized with the enhancement frame, the amount of calculation of perceptual masking is reduced to ⅛. Furthermore, in this case, the perceptual masking is obtained by the base frame first and then the same perceptual masking is used for all enhancement frames.

The MDCT coefficients quantization section 1703 quantizes the MDCT coefficients X(j,m) at the positions determined by the quantization position determining section 1702. When performing quantization, the MDCT coefficients quantization section 1703 uses information on the perceptual masking M(j,m) and performs quantization so that the quantization error falls below the perceptual masking M(j,m). When the quantized MDCT coefficients are assumed to be X'(j,m), the MDCT coefficients quantization section 1703 performs quantization so as to satisfy Expression (21) shown below.

$$|X(j,m)-X'(j,m)|\leqq M(j,m) \tag{21}$$

Then, the MDCT coefficients quantization section 1703 outputs the quantized codes to the multiplexer 1705.

The quantization position coder 1704 encodes the position information. For example, the quantization position coder 1704 encodes the position information using a run-length coding method. The quantization position coder 1704 scans from the lowest frequency in the time-axis direction and performs coding in such a way that the number of positions in which coefficients to be coded do not exist continuously and the number of positions in which coefficients to be coded exist continuously are regarded as the position information.

More specifically, the quantization position coder 1704 scans from (j,m)=(1,1) in the direction in which j increases and performs coding using the number of positions until the coefficient to be coded appears as the position information.

In FIG. 20, the distance from (j,m)=(1,1) to the position (j,m)=(1,6) of the coefficient which becomes the first coding target is 5, and then, since only one coefficient to be coded exists continuously, the number of positions in which coefficients to be coded exist continuously is 1, and then the number of positions in which coefficients not to be coded exist continuously is 14. In this way, in FIG. 20, codes expressing position information are 5, 1, 14, 1, 4, 1, 4 . . . , 5, 1, 3. The quantization position coder 1704 outputs this position information to the multiplexer 1705. The multiplexer 1705 multiplexes the information on the quantization of the MDCT coefficients X(j,m) and position information and outputs the multiplexing result to the multiplexer 109.

Figure 21:
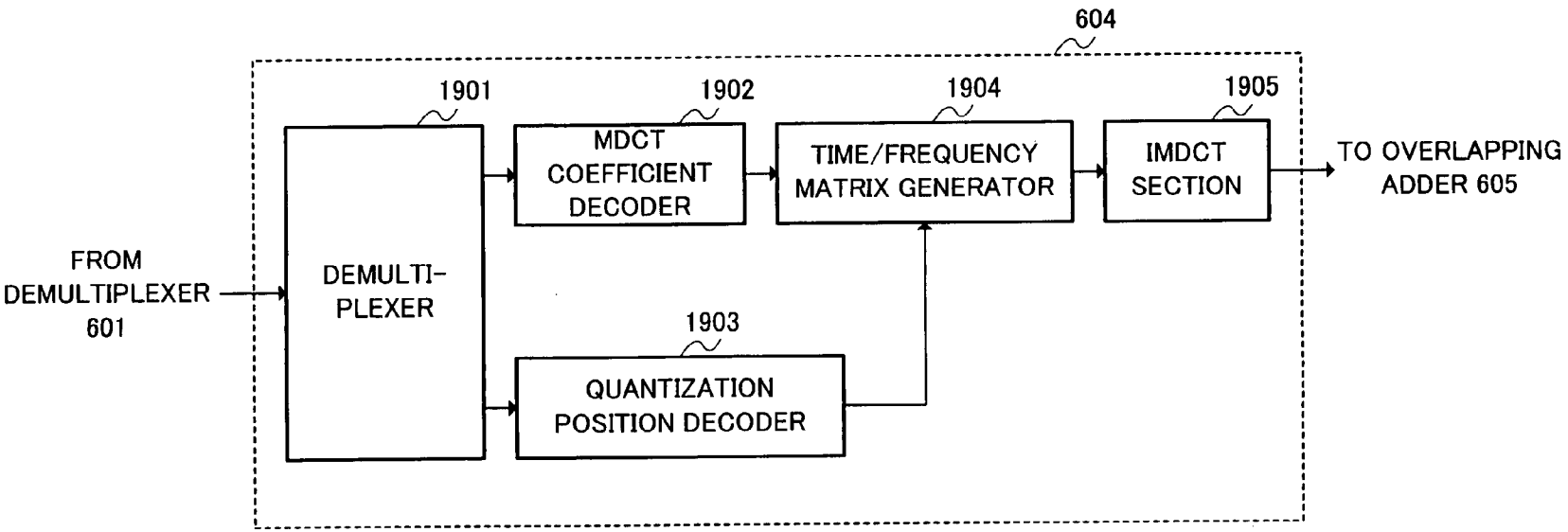
FIG. 21 is a block diagram showing an example of the internal configuration of an enhancement layer decoder according to Embodiment 5 of the present invention.

Next, the decoding side will be explained. FIG. 21 is a block diagram showing an example of the internal configuration of an enhancement layer decoder according to Embodiment 5 of the present invention. FIG. 21 shows an example of the internal configuration of the enhancement layer decoder 604 in FIG. 8. The enhancement layer decoder 604 in FIG. 21 is mainly constructed of a demultiplexer 1901, an MDCT coefficients decoder 1902, a quantization position decoder 1903, a time-frequency matrix generator 1904 and an IMDCT section 1905.

The demultiplexer 1901 separates a second coded code output from the demultiplexer 601 into MDCT coefficient quantization information and quantization position information, outputs the MDCT coefficient quantization information to the MDCT coefficient decoder 1902 and outputs the quantization position information to the quantization position decoder 1903.

The MDCT coefficient decoder 1902 decodes the MDCT coefficients from the MDCT coefficient quantization information output from the demultiplexer 1901 and outputs the decoded MDCT coefficients to the time-frequency matrix generator 1904.

The quantization position decoder 1903 decodes the quantization position information from the quantization position information output from the demultiplexer 1901 and outputs the decoded quantization position information to the time-frequency matrix generator 1904. This quantization position information is the information indicating the positions of the decoded MDCT coefficients in the time-frequency matrix.

The time-frequency matrix generator 1904 generates the time-frequency matrix shown in FIG. 20 using the quantization position information output from the quantization position decoder 1903 and the decoded MDCT coefficients output from the MDCT coefficient decoder 1902. FIG. 20 shows the positions at which the decoded MDCT coefficients exist with shaded areas and shows the positions at which the decoded MDCT coefficients do not exist with white areas. At the positions in the white areas, no decoded MDCT coefficients exist, and therefore 0s are provided as the decoded MDCT coefficients.

Then, the time-frequency matrix generator 1904 outputs the decoded MDCT coefficients to the IMDCT section 1905 for every enhancement frame (j=1 to J). The IMDCT section 1905 applies an IMDCT to the decoded MDCT coefficients, generates a signal in the time domain and outputs the signal to the overlapping adder 605.

Thus, the acoustic coding apparatus and acoustic decoding apparatus of this embodiment transforms a residual signal from a time domain to a frequency domain during coding in the enhancement layer, and then performs perceptual masking to determine the coefficients to be coded and encodes the two-dimensional position information on a frequency and a frame number, and can thereby reduce an amount of information on positions taking advantage of the fact the positions of coefficients to be coded and coefficients not to be coded are continuous and perform coding at a low bit rate and with high quality.

Embodiment 6

Figure 22:
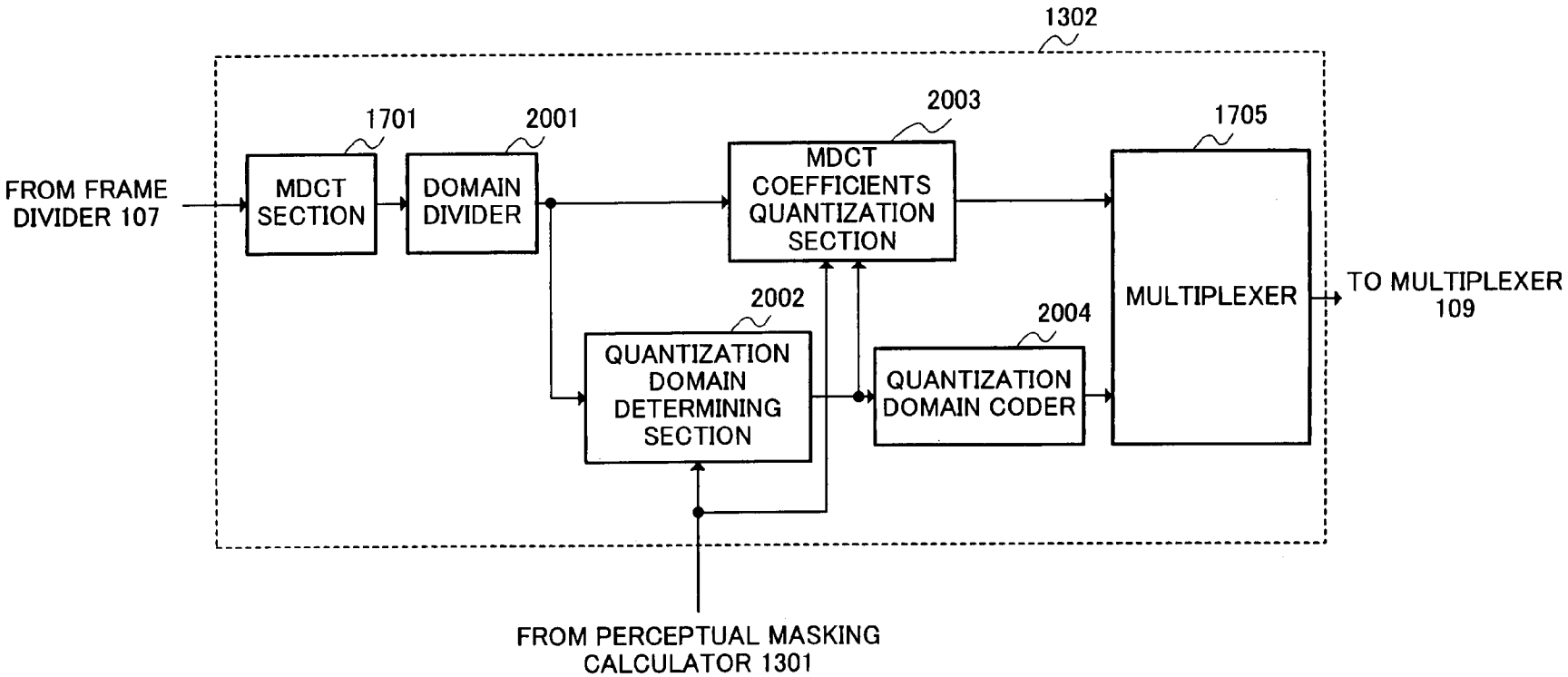
FIG. 22 is a block diagram showing an example of the internal configuration of an enhancement layer coder according to Embodiment 6 of the present invention.

FIG. 22 is a block diagram showing an example of the internal configuration of an enhancement layer coder according to Embodiment 6 of the present invention. FIG. 22 shows an example of the internal configuration of the enhancement layer coder 1302 in FIG. 15. However, the same components as those in FIG. 19 are assigned the same reference numerals as those in FIG. 19 and detailed explanations thereof will be omitted. The enhancement layer coder 1302 in FIG. 22 is provided with a domain divider 2001, a quantization domain determining section 2002, an MDCT coefficients quantization section 2003 and a quantization domain coder 2004 and relates to another method of efficiently coding position information on MDCT coefficients when MDCT coefficients exceeding perceptual masking are quantization targets.

The domain divider 2001 divides MDCT coefficients X(j, m) obtained by the MDCT section 1701 into plural domains. The domain here refers to a set of positions of plural MDCT coefficients and is predetermined as information common to both the coder and decoder.

The quantization domain determining section 2002 determines domains to be quantized. More specifically, when a domain is expressed as S(k)(k=1 to K), the quantization domain determining section 2002 calculates the sum total of the amounts by which these MDCT coefficients X(j,m) exceed perceptual masking M(m) included in the domain S(k) and selects K' (K'<K) domains in descending order in the magnitude of this sum total.

Figure 23:
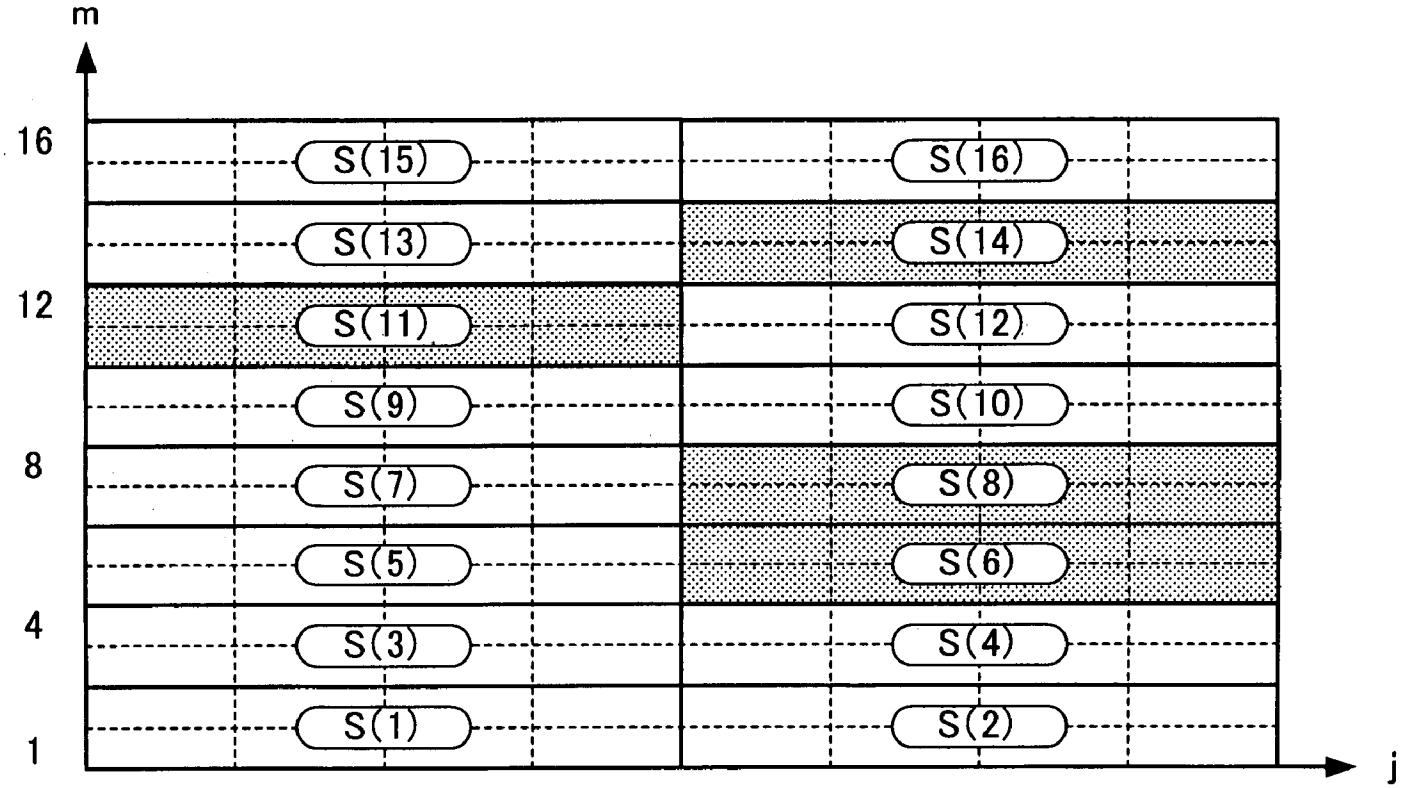
FIG. 23 illustrates an example of the arrangement of MDCT coefficients.

FIG. 23 shows an example of the arrangement of MDCT coefficients. FIG. 23 shows an example of the domain S(k) The shaded areas in FIG. 23 denote the domains to be quantized determined by the quantization domain determining section 2002. In this example, the domain S(k) is a rectangle which is four-dimensional in the time-axis direction and two-dimensional in the frequency-axis direction and the quantization targets are four domains of S(6), S(8), S(11) and S(14).

As described above, the quantization domain determining section 2002 determines which domains S(k) should be quantized according to the sum total of amounts by which the MDCT coefficients X(j,m) exceed perceptual masking M(j, m). The sum total V(k) is calculated by Expression (22) below:

$$V(k) = \sum_{(j,m)\in S(k)} (\mathrm{MAX}(|X(j,m)| - M(j,m), 0))^2 \tag{22}$$

According to this method, high frequency domains V(k) may be hardly selected depending on the input signal. Therefore, instead of Expression (22), it is also possible to use a method of normalizing with intensity of MDCT coefficients X(j,m) expressed in Expression (23) shown below:

$$V(k) = \frac{\sum_{(j,m)\in S(k)} (\mathrm{MAX}(|X(j,m)| - M(j,m), 0))^2}{\sum_{(j,m)\in S(k)} X(j,m)^2} \tag{23}$$

Then, the quantization domain determining section 2002 outputs information on the domains to be quantized to the MDCT coefficients quantization section 2003 and quantization domain coder 2004.

The quantization domain coder 2004 assigns code 1 to domains to be quantized and code 0 to other domains and outputs the codes to the multiplexer 1705. In the case of FIG. 23, the codes become 0000, 0101, 0010, 0100. Furthermore, this code can also be expressed using a run-length coding method. In that case, the codes obtained are 5, 1, 1, 1, 2, 1, 2, 1, 2.

The MDCT coefficients quantization section 2003 quantizes the MDCT coefficients included in the domains determined by the quantization domain determining section 2002. As a method of quantization, it is also possible to construct one or more vectors from the MDCT coefficients included in the domains and perform vector quantization. In performing vector quantization, it is also possible to use a scale weighted by perceptual masking M(j,m).

Figure 24:
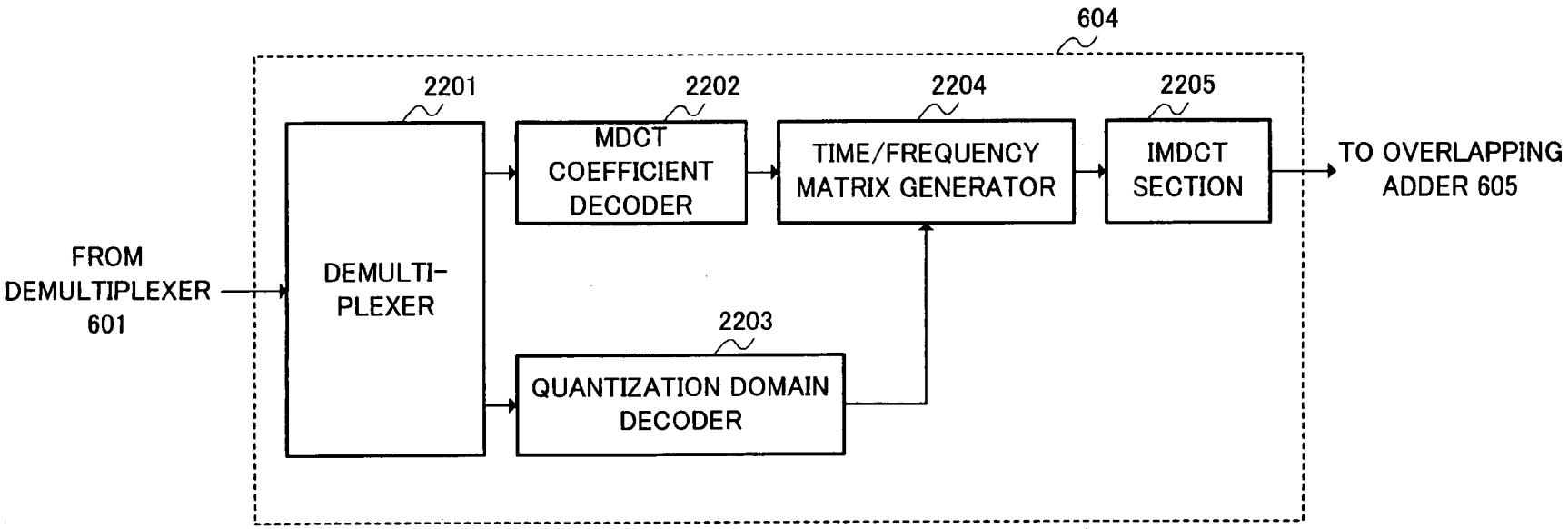
FIG. 24 is a block diagram showing an example of the internal configuration of an enhancement layer decoder according to Embodiment 6 of the present invention.

Next, the decoding side will be explained. FIG. 24 is a block diagram showing an example of the internal configuration of an enhancement layer decoder according to Embodiment 6 of the present invention. FIG. 24 shows an example of the internal configuration of the enhancement layer decoder 604 in FIG. 8. The enhancement layer decoder 604 in FIG. 24 is mainly constructed of a demultiplexer 2201, an MDCT coefficient decoder 2202, a quantization domain decoder 2203, a time-frequency matrix generator 2204 and an IMDCT section 2205.

A feature of this embodiment is the ability to decode coded codes generated by the aforementioned enhancement layer coder 1302 of Embodiment 6.

The demultiplexer 2201 separates a second coded code output from the demultiplexer 601 into MDCT coefficient quantization information and quantization domain information, outputs the MDCT coefficient quantization information to the MDCT coefficient decoder 2202 and outputs the quantization domain information to the quantization domain decoder 2203.

The MDCT coefficient decoder 2202 decodes the MDCT coefficients from the MDCT coefficient quantization information obtained from the demultiplexer 2201. The quantization domain decoder 2203 decodes the quantization domain information from the quantization domain information obtained from the demultiplexer 2201. This quantization domain information is information expressing to which domain in the time frequency matrix the respective decoded MDCT coefficients belong.

The time-frequency matrix generator 2204 generates a time-frequency matrix shown in FIG. 23 using the quantization domain information obtained from the quantization domain decoder 2203 and the decoded MDCT coefficients obtained from the MDCT coefficient decoder 2202. In FIG. 23, the domains where decoded MDCT coefficients exist are expressed by shaded areas and domains where no decoded MDCT coefficients exist are expressed by white areas. The white areas provide 0s as decoded MDCT coefficients because no decoded MDCT coefficients exist.

Then, the time-frequency matrix generator 2204 outputs a decoded MDCT coefficient for every enhancement frame (j=1 to J) to the IMDCT section 2205. The IMDCT section 2205 applies an IMDCT to the decoded MDCT coefficients, generates signals in the time domain and outputs the signals to the overlapping adder 605.

Thus, the acoustic coding apparatus and acoustic decoding apparatus of this embodiment set position information of the time domain and the frequency domain in which residual signals exceeding the perceptual masking exist in group units (domains), and can thereby express the positions of domains to be coded with fewer bits and realize a low bit rate.

Embodiment 7

Figure 25:
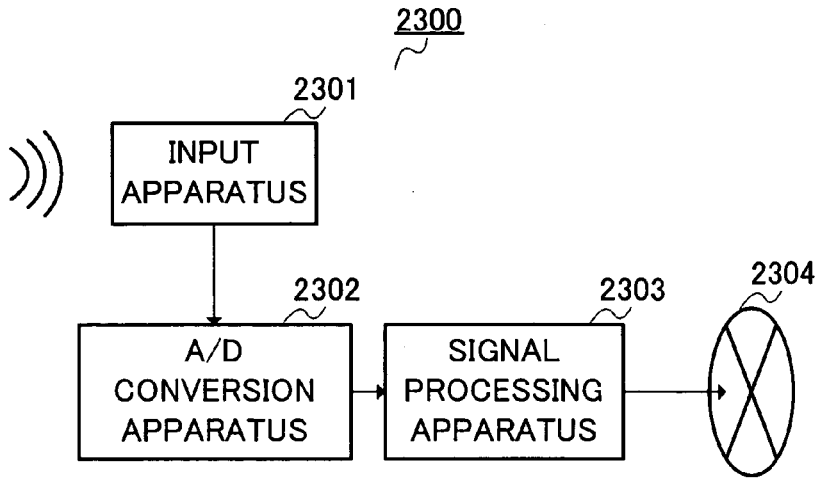
FIG. 25 is a block diagram showing the configuration of a communication apparatus according to Embodiment 7 of the present invention.

Next, Embodiment 7 will be explained with reference to the attached drawings. FIG. 25 is a block diagram showing the configuration of a communication apparatus according to Embodiment 7 of the present invention. This embodiment is characterized in that the signal processing apparatus 2303 in FIG. 25 is constructed of one of the aforementioned acoustic coding apparatuses shown in Embodiment 1 to Embodiment 6.

As shown in FIG. 25, a communication apparatus 2300 according to Embodiment 7 of the present invention is provided with an input apparatus 2301, an A/D conversion apparatus 2302 and a signal processing apparatus 2303 connected to a network 2304.

The A/D conversion apparatus 2302 is connected to the output terminal of the input apparatus 2301. The input terminal of the signal processing apparatus 2303 is connected to the output terminal of the A/D conversion apparatus 2302. The output terminal of the signal processing apparatus 2303 is connected to the network 2304.

The input apparatus 2301 converts a sound wave audible to the human ears to an analog signal which is an electric signal and gives it to the A/D conversion apparatus 2302. The A/D conversion apparatus 2302 converts the analog signal to a digital signal and gives it to the signal processing apparatus 2303. The signal processing apparatus 2303 encodes the digital signal input, generates a code and outputs the code to the network 2304.

In this way, the communication apparatus according to this embodiment of the present invention can provide an acoustic coding apparatus capable of realizing the effects shown in Embodiments 1 to 6 and efficiently coding acoustic signals with fewer bits.

Embodiment 8

Figure 26:
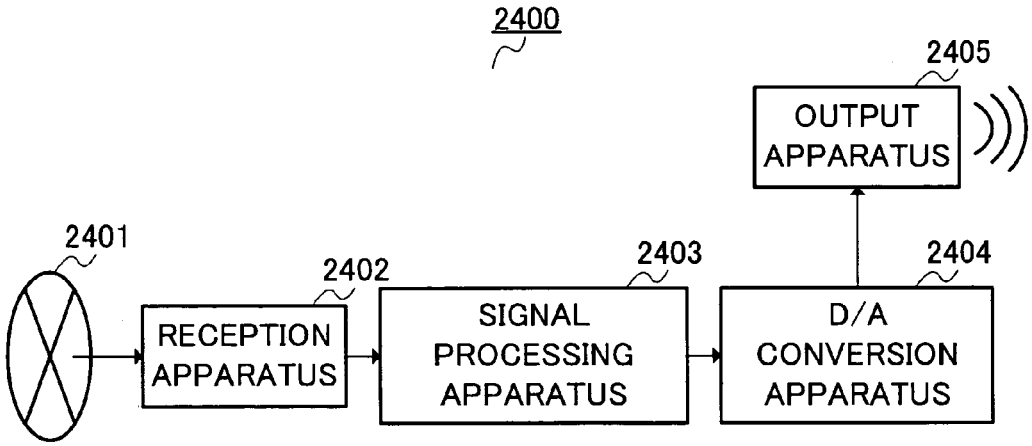
FIG. 26 is a block diagram showing the configuration of a communication apparatus according to Embodiment 8 of the present invention.

Next, Embodiment 8 of the present invention will be explained with reference to the attached drawings. FIG. 26 is a block diagram showing the configuration of a communication apparatus according to Embodiment 8 of the present invention. This embodiment is characterized in that the signal processing apparatus 2403 in FIG. 26 is constructed of one of the aforementioned acoustic decoding apparatuses shown in Embodiment 1 to Embodiment 6.

As shown in FIG. 26, the communication apparatus 2400 according to Embodiment 8 of the present invention is provided with a reception apparatus 2402 connected to a network 2401, a signal processing apparatus 2403, a D/A conversion apparatus 2404 and an output apparatus 2405.

The input terminal of the reception apparatus 2402 is connected to a network 2401. The input terminal of the signal processing apparatus 2403 is connected to the output terminal of the reception apparatus 2402. The input terminal of the D/A conversion apparatus 2404 is connected to the output terminal of the signal processing apparatus 2403. The input terminal of the output apparatus 2405 is connected to the output terminal of the D/A conversion apparatus 2404.

The reception apparatus 2402 receives a digital coded acoustic signal from the network 2401, generates a digital received acoustic signal and gives it to the signal processing apparatus 2403. The signal processing apparatus 2403 receives the received acoustic signal from the reception apparatus 2402, applies decoding processing to this received acoustic signal, generates a digital decoded acoustic signal and gives it to the D/A conversion apparatus 2404. The D/A conversion apparatus 2404 converts the digital decoded speech signal from the signal processing apparatus 2403, generates an analog decoded speech signal and gives it to the output apparatus 2405. The output apparatus 2405 converts the analog decoded acoustic signal which is an electric signal to vibration of the air and outputs it as sound wave audible to the human ears.

Thus, the communication apparatus of this embodiment can realize the aforementioned effects in communications shown in Embodiments 1 to 6, decode coded acoustic signals efficiently with fewer bits and thereby output a high quality acoustic signal.

Embodiment 9

Figure 27:
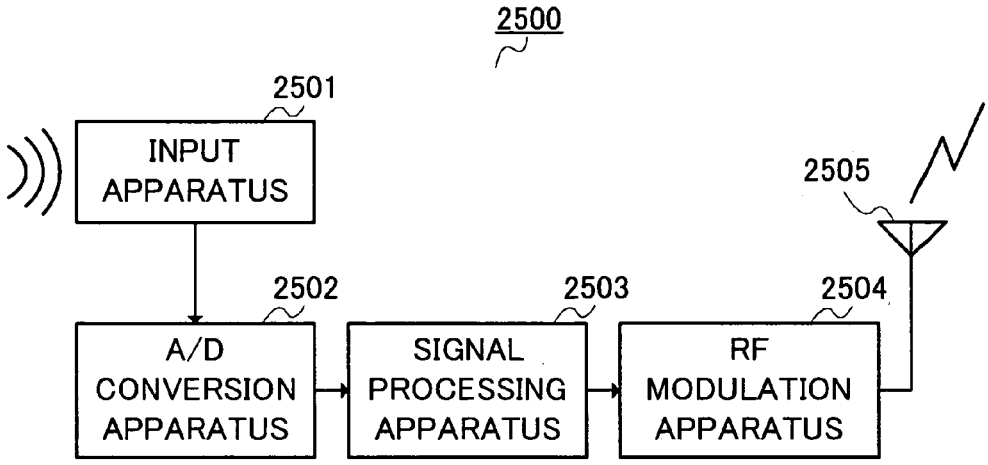
FIG. 27 is a block diagram showing the configuration of a communication apparatus according to Embodiment 9 of the present invention.

Next, Embodiment 9 of the present invention will be explained with reference to the attached drawings. FIG. 27 is a block diagram showing the configuration of a communication apparatus according to Embodiment 9 of the present invention. Embodiment 9 of the present invention is characterized in that the signal processing apparatus 2503 in FIG. 27 is constructed of one of the aforementioned acoustic coding sections shown in Embodiment 1 to Embodiment 6.

As shown in FIG. 27, the communication apparatus 2500 according to Embodiment 9 of the present invention is provided with an input apparatus 2501, an A/D conversion apparatus 2502, a signal processing apparatus 2503, an RF modulation apparatus 2504 and an antenna 2505.

The input apparatus 2501 converts a sound wave audible to the human ears to an analog signal which is an electric signal and gives it to the A/D conversion apparatus 2502. The A/D conversion apparatus 2502 converts the analog signal to a digital signal and gives it to the signal processing apparatus 2503. The signal processing apparatus 2503 encodes the input digital signal, generates a coded acoustic signal and gives it to the RF modulation apparatus 2504. The RF modulation apparatus 2504 modulates the coded acoustic signal, generates a modulated coded acoustic signal and gives it to the antenna 2505. The antenna 2505 sends the modulated coded acoustic signal as a radio wave.

Thus, the communication apparatus of this embodiment can realize the aforementioned effects in a radio communication as shown in Embodiments 1 to 6 and efficiently encode an acoustic signal with fewer bits.

The present invention is applicable to a transmission apparatus, transmission coding apparatus or acoustic signal coding apparatus using an audio signal. Furthermore, the present invention is also applicable to a mobile station apparatus or base station apparatus.

Embodiment 10

Figure 28:
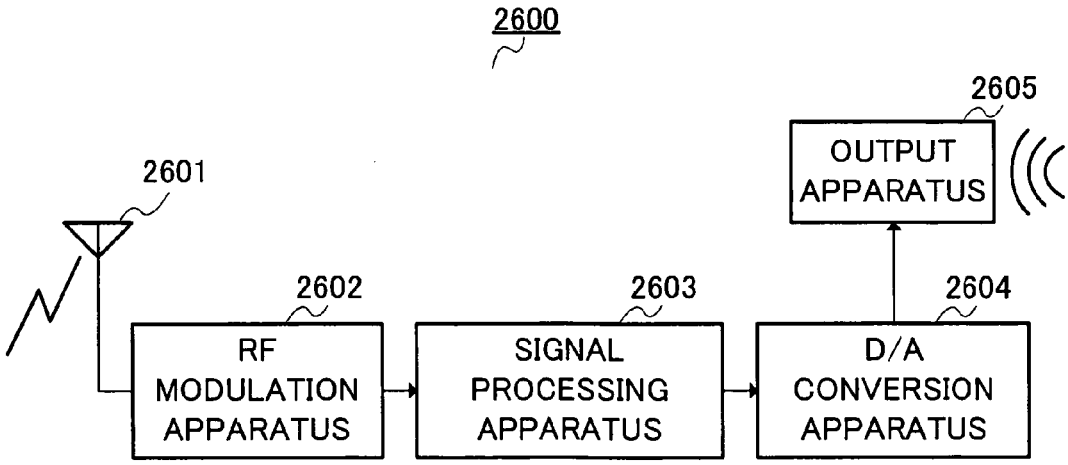
FIG. 28 is a block diagram showing the configuration of a communication apparatus according to Embodiment 10 of the present invention.

Next, Embodiment 10 of the present invention will be explained with reference to the attached drawings. FIG. 28 is a block diagram showing the configuration of a communication apparatus according to Embodiment 10 of the present invention. Embodiment 10 of the present invention is characterized in that the signal processing apparatus 2603 in FIG. 28 is constructed of one of the aforementioned acoustic decoding sections shown in Embodiment 1 to Embodiment 6.

As shown in FIG. 28, the communication apparatus 2600 according to Embodiment 10 of the present invention is provided with an antenna 2601, an RF demodulation apparatus 2602, a signal processing apparatus 2603, a D/A conversion apparatus 2604 and an output apparatus 2605.

The antenna 2601 receives a digital coded acoustic signal as a radio wave, generates a digital received coded acoustic signal which is an electric signal and gives it to the RF demodulation apparatus 2602. The RF demodulation apparatus 2602 demodulates the received coded acoustic signal from the antenna 2601, generates a demodulated coded acoustic signal and gives it to the signal processing apparatus 2603.

The signal processing apparatus 2603 receives the digital demodulated coded acoustic signal from the RF demodulation apparatus 2602, carries out decoding processing, generates a digital decoded acoustic signal and gives it to the D/A conversion apparatus 2604. The D/A conversion apparatus 2604 converts the digital decoded speech signal from the signal processing apparatus 2603, generates an analog decoded speech signal and gives it to the output apparatus 2605. The output apparatus 2605 converts the analog decoded speech signal which is an electric signal to vibration of the air and outputs it as a sound wave audible to the human ears.

Thus, the communication apparatus of this embodiment can realize the aforementioned effects in a radio communication as shown in Embodiments 1 to 6, decode a coded acoustic signal efficiently with fewer bits and thereby output a high quality acoustic signal.

The present invention is applicable to a reception apparatus, reception decoding apparatus or speech signal decoding apparatus using an audio signal. Furthermore, the present invention is also applicable to a mobile station apparatus or base station apparatus.

Furthermore, the present invention is not limited to the above embodiments, but can be implemented modified in various ways. For example, the above embodiments have described the case where the present invention is implemented as a signal processing apparatus, but the present invention is not limited to this and this signal processing method can also be implemented by software.

For example, it is possible to store a program for executing the above described signal processing method in a ROM (Read Only Memory) beforehand and operate the program by a CPU (Central Processor Unit).

Furthermore, it is also possible to store a program for executing the above described signal processing method in a computer-readable storage medium, record the program stored in the storage medium in a RAM (Random Access memory) of a computer and operate the computer according to the program.

The above described explanations have described the case where an MDCT is used as the method of transform from a time domain to a frequency domain, but the present invention is not limited to this and any method is applicable if it provides at least an orthogonal transform. For example, a discrete Fourier transform or discrete cosine transform, etc., can be used.

The present invention is applicable to a reception apparatus, reception decoding apparatus or speech signal decoding apparatus using an audio signal. Furthermore, the present invention is also applicable to a mobile station apparatus or base station apparatus.

As is evident from the above described explanations, the acoustic coding apparatus and acoustic coding method of the present invention encodes an enhancement layer with the time length of a frame in the enhancement layer set to be shorter than the time length of a frame in the base layer, and can thereby code even a signal which consists predominantly of speech with music and noise superimposed in the background, with a short delay, at a low bit rate and with high quality.

This application is based on the Japanese Patent Application No. 2002-261549 filed on Sep. 6, 2002, entire content of which is expressly incorporated by reference herein.

INDUSTRIAL APPLICABILITY

The present invention is preferably applicable to an acoustic coding apparatus and a communication apparatus which efficiently compresses and encodes an acoustic signal such as a music signal or speech signal.

Figure 1:
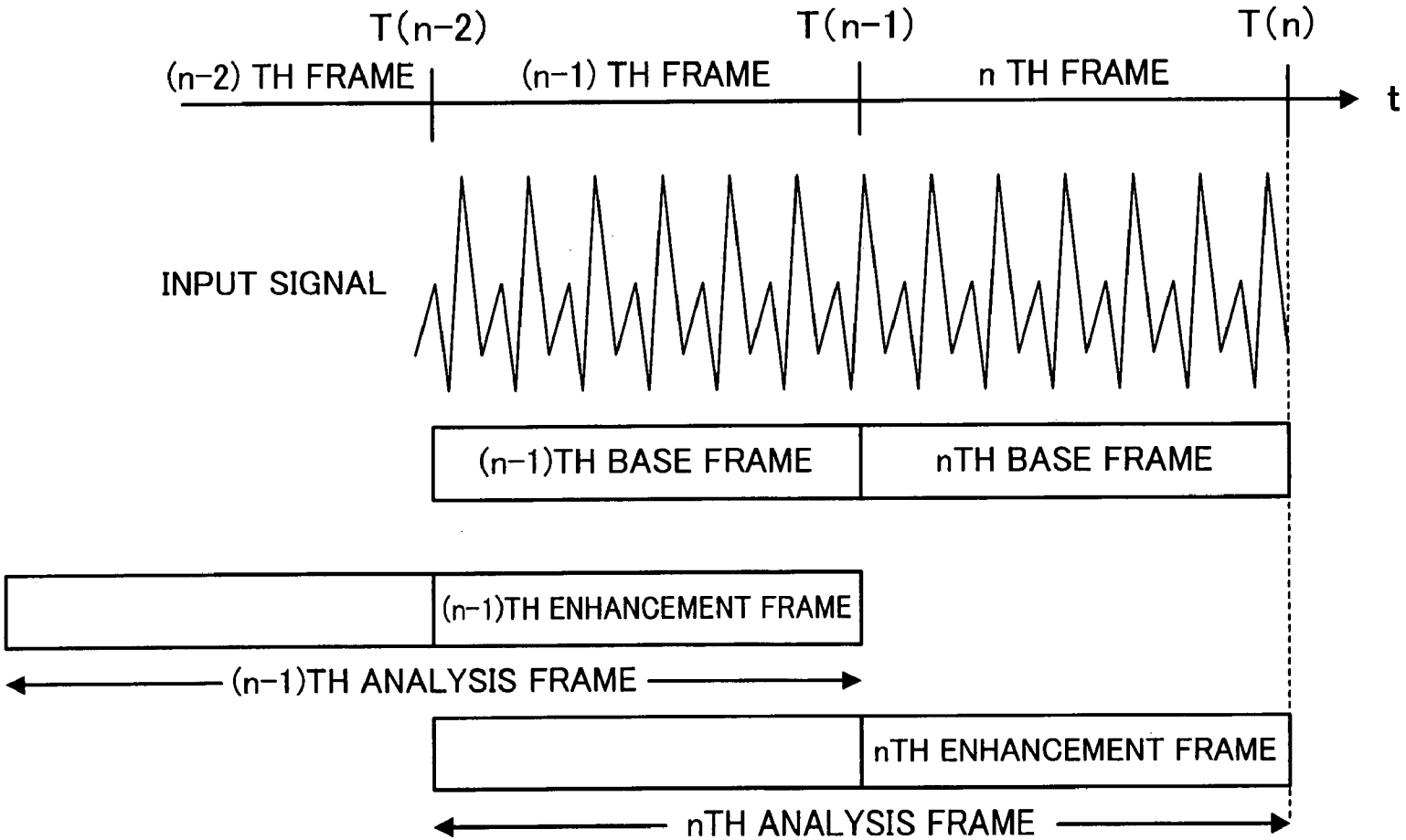
PRIOR ART FIG.1
FIG. 1 illustrates an example of frames of a base layer (base frames) and frames of an enhancement layer (enhancement frames) in conventional speech coding.
Figure 2:
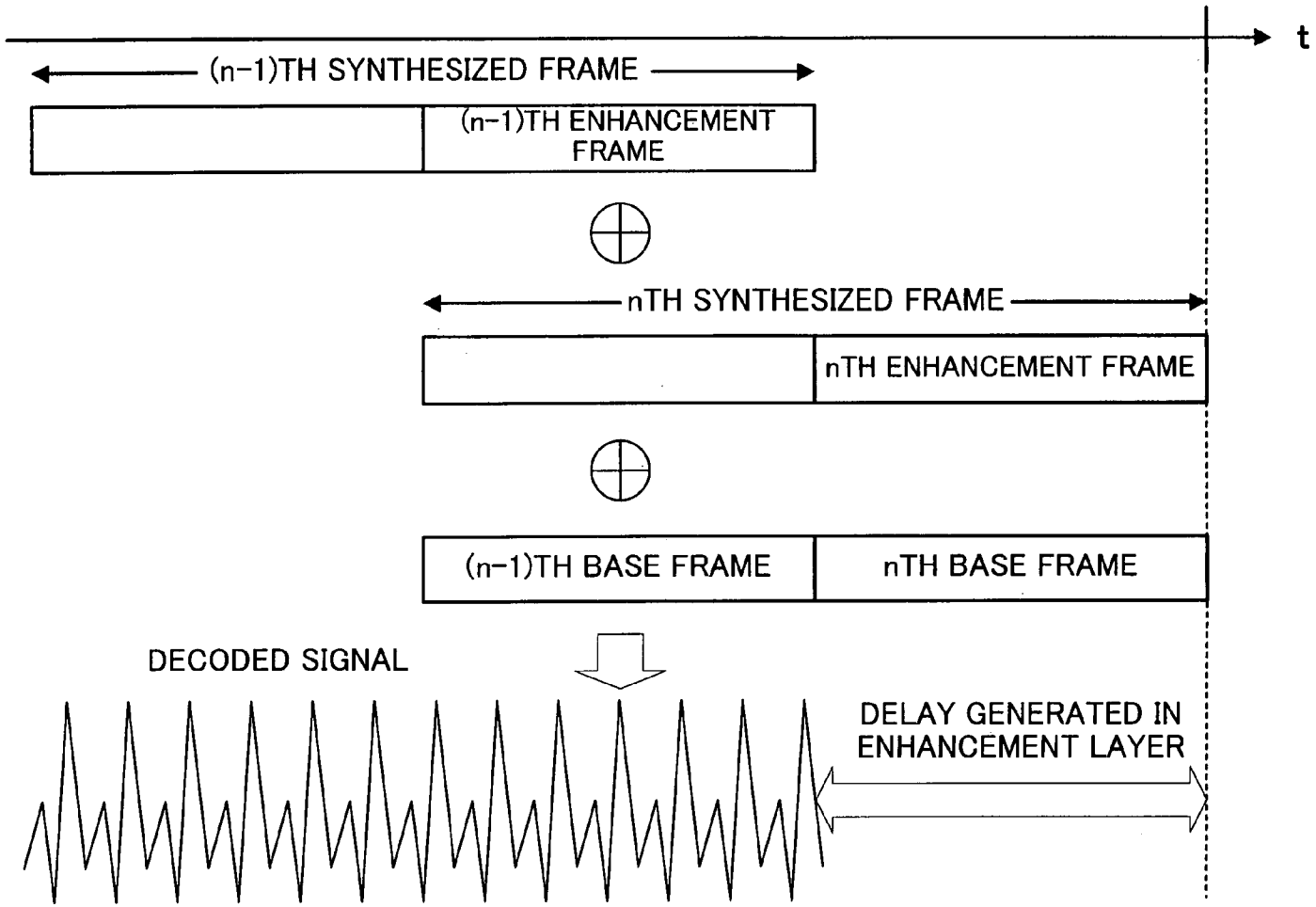
PRIOR ART FIG.2
FIG. 2 illustrates an example of frames of a base layer (base frames) and frames of an enhancement layer (enhancement frames) in conventional speech decoding.

[FIG. 1]
(n-2)TH FRAME (n-1)TH FRAME nTH FRAME
INPUT SIGNAL
(n-1)TH BASE FRAME nTH BASE FRAME
(n-1)TH ENHANCEMENT FRAME
(n-1)TH ANALYSIS FRAME
nTH ENHANCEMENT FRAME
nTH ANALYSIS FRAME
[FIG. 2]
(n-1)TH SYNTHESIZED FRAME
(n-1)TH ENHANCEMENT FRAME
nTH SYNTHESIZED FRAME
nTH ENHANCEMENT FRAME
(n-1)TH BASE FRAME
nTH BASE FRAME
DECODED SIGNAL
DELAY GENERATED IN ENHANCEMENT LAYER
[FIG. 3]
INPUT SIGNAL
101 DOWNSAMPLER
102 BASE LAYER CODER
103 LOCAL DECODER
104 UPSAMPLER
105 DELAYER
107 FRAME DIVIDER
108 ENHANCEMENT LAYER CODER
109 MULTIPLEXER
[FIG. 4]
AMOUNT OF INFORMATION
BACKGROUND MUSIC/BACKGROUND NOISE INFORMATION
SPEECH INFORMATION
FREQUENCY
[FIG. 5]
AMOUNT OF INFORMATION
BASE LAYER
ENHANCEMENT LAYER
FREQUENCY
[FIG. 6]
(n-1)TH FRAME nTH FRAME
INPUT SIGNAL
nTH BASE FRAME
ENHANCEMENT FRAME
[FIG. 7]
ENHANCEMENT FRAME
nTH BASE FRAME
DECODED SIGNAL [Fig 8]
CODED DATA
601 DEMULTIPLEXER
602 BASE LAYER DECODER
603 UPSAMPLER
604 ENHANCEMENT LATER DECODER
605 OVERLAPPING ADDER
[FIG. 9]
FROM DONWSAMPLER 101
702 PERCEPTUAL WEIGHTING SECTION
705 TARGET VECTOR GENERATOR
703 ADAPTIVE CODEBOOK SEARCHER
706 NOISE CODEBOOK SEARCHER
704 ADAPTIVE VECTOR GAIN QUANTIZER
707 NOISE VECTOR GAIN QUANTIZER
701 LPC ANALYZER
708 MULTIPLEXER
TO LOCAL DECODER 103 AND MULTIPLEXER 109
[FIG. 10]
FROM DEMULTIPLEXER 601
801 DEMULTIPLEXER
802 EXCITATION GENERATOR
803 SYNTHESIS FILTER
TO UPSAMPLER 603
[FIG. 11]
FROM DEMULTIPLEXER 601
801 DEMULTIPLEXER
802 EXCITATION GENERATOR
803 SYNTHESIS FILTER
901 POST FILTER

TO UPSAMPLER 603
[FIG. 12]
FROM FRAME DIVIDER 107
1001 MDCT SECTION
1002 QUANTIZER
TO MULTIPLEXER 109
[FIG. 13]
nTH BASE FRAME
nTH ENHANCEMENT FRAME
FREQUENCY (m)
TIME (j)
[FIG. 14]
FROM DEMULTIPLEXER 601
1201 MDCT COEFFICIENT DECODER
1202 IMDCT SECTION
TO OVERLAPPING ADDER 605
[FIG. 15]
INPUT SIGNAL
101 DOWNSAMPLER
102 BASE LAYER CODER
103 LOCAL DECODER
104 UPSAMPLER
105 DELAYER
1301 PERCEPTUAL MASKING CALCULATION SECTION
107 FRAME DIVIDER
1302 ENHANCEMENT LAYER CODER
109 MULTIPLEXER
[FIG. 16]
FROM DELAYER 105
1401 FFT SECTION
1402 BARK SPECTRUM CALCULATOR
1403 SPREAD FUNCTION CONVOLUTER
1405 PERCEPTUAL MASKING CALCULATOR
1404 TONALITY CALCULATOR
TO ENHANCEMENT LAYER CODER 1302
[FIG. 17]
FROM FRAME DIVIDER 107
1501 MDCT SECTION
1502 MDCT COEFFICIENT QUANTIZER
TO MULTIPLEXER 109
FROM PERCEPTUAL MASKING CALCULATOR 1301
[FIG. 18]
FROM DELAYER 105
1601 MDCT SECTION
1402 BARK SPECTRUM CALCULATOR
1403 SPREAD FUNCTION CONVOLUTER
1405 PERCEPTUAL MASKING CALCULATOR
1404 TONALITY CALCULATOR
TO ENHANCEMENT LAYER CODER 1302
[FIG. 19]
FROM FRAME DIVIDER 107
1701 MDCT SECTION
1703 MDCT COEFFICIENTS QUANTIZATION SECTION
1702 QUANTIZATION POSITION DETERMINING SECTION
FROM PERCEPTUAL MASKING CALCULATOR 1301
1704 QUANTIZATION POSITION CODER
1705 MULTIPLEXER
109 TO MULTIPLEXER 109
[FIG. 21]
FROM DEMULTIPLEXER 601
1901 DEMULTIPLEXER
1902 MDCT COEEFICIENT DOCODER
1903 QUANTIZATION POSITION DECODER
1904 TIME/FREQUENCY MATRIX GENERATOR
1905 IMDCT SECTION
TO OVERLAPPING ADDER 605
[FIG. 22]
FROM FRAME DIVIDER 107
1701 MDCT SECTION
2001 DOMAIN DIVIDER
2003 MDCT COEFFICIETS QUANTIZATION SECTION
2002 QUANTIZATION DOMAIN DETERMINING SECTION
FROM PERCEPTUAL MASKING CALCULATOR 1301
2004 QUANTIZATION DOMAIN CODER
1705 MULTIPLEXER
109 TO MULTIPLEXER 109
[FIG. 24]
FROM DEMULTIPLEXER 601
2201 DEMULTIPLEXER
2202 MDCT COEFFICIENT DECODER
2203 QUANTIZATION DOMAIN DECODER
2204 TIME/FREQUENCY MATRIX GENERATOR
2205 IMDCT SECTION
TO OVERLAPPING ADDER 605
[FIG. 25]
2301 INPUT APPARATUS
2302 A/D CONVERSION APPARATUS
2303 SIGNAL PROCESSING APPARATUS
[FIG. 26]
2405 OUTPUT APPARATUS
2402 RECEPTION APPARATUS
2403 SIGNAL PROCESSING APPARATUS
2404 D/A CONVERSION APPARATUS
[FIG. 27]
2501 INPUT APPARATUS
2502 A/D CONVERSION APPARATUS
2503 SIGNAL PROCESSING APPARATUS
2504 RF MODULATION APPARATUS
[FIG. 28]
2605 OUTPUT APPARATUS
2602 RF MODULATION APPARATUS
2603 SIGNAL PROCESSING APPARATUS
2604 D/A CONVERSION APPARATUS

What is claimed is:

1. An acoustic coding apparatus comprising a processor comprising:

a base layer coding section that encodes an input signal per base frame and obtains a base layer coded code;

a decoding section that decodes the base layer coded code and obtains a decoded signal;

a subtraction section that obtains a residual signal between the input signal and the decoded signal;

a frame division section that divides the residual signal into a plurality of residual signals in units of an enhancement frame having a shorter time length than the base frame;

an enhancement layer coding section performed by the processor that encodes the plurality of residual signals and obtains an enhancement layer coded code; and a multiplexing section that multiplexes the base layer coded code and the enhancement layer coded code to output a multiplexed code, wherein the enhancement layer coding section comprises:

a frequency domain transform section that transforms the plurality of residual signals in the frequency domain and obtains a plurality of frequency domain transform coefficients represented on a two dimensional plane comprised of a time axis and a frequency axis;

a domain divider that divides the plurality of frequency domain transform coefficients into a plurality of domains on the two dimensional plane such that each domain includes at least a plurality of frequency domain transform coefficients which are grouped continuously along a time axis;

a quantization domain determining section that determines a part of the plurality of domains in each base frame to be quantization targets based on power spectrum values of the frequency domain transform coefficients within each domain and outputs domain information showing the part of the plurality of domains; and a quantization domain coding section that encodes the domain information and the frequency domain transform coefficients within the part of the plurality of domains shown by the domain information, and obtains the enhancement layer coded code.

2. The acoustic coding apparatus according to claim 1, wherein the base layer coding section encodes the input signal using a code excited linear prediction coding.

3. The acoustic coding apparatus according to claim 1, wherein the enhancement layer coding section transforms the residual signal from the time domain to the frequency domain using a modified discrete cosine transform.

4. The acoustic coding apparatus according to claim 3, wherein the enhancement layer coding section encodes only part of a band, shown by the domain information, of the residual signal transformed to the frequency domain.

5. The acoustic coding apparatus according to claim 3, further comprising a perceptual masking section that calculates perceptual masking expressing an amplitude value which does not affect auditory perception, wherein the enhancement layer coding section does not regard signals in the perceptual masking as coding targets.

6. The acoustic coding apparatus according to claim 5, wherein the enhancement layer coding section calculates a difference between the perceptual masking and the residual signal, regards a residual signal for which the difference is relatively large as a coding target and encodes positions in the time domain and the frequency domain in which the residual signal exists on the two dimensional plane.

7. An acoustic decoding apparatus comprising a processor comprising:

a demultiplexing section that demultiplexes a code coded by an acoustic coding apparatus into a base layer coded code and an enhancement layer coded code;

a base layer decoding section that decodes the base layer coded code which is generated at a coding side in predetermined base frame units and obtains a base layer signal; and an enhancement layer decoding section performed by the processor that decodes the enhancement layer coded code which is generated at the coding side in units of an enhancement frame having a shorter time length than a base frame and obtains an enhancement layer signal;

wherein the enhancement layer decoding section comprises:

a domain divider that, on a two dimensional plane comprised of a time axis and a frequency axis, divides a plurality of frequency domain transform coefficients into a plurality of domains such that each domain includes at least a plurality of frequency transform coefficients which are grouped continuously along a time axis;

a quantization domain determining section that generates domain information from enhancement layer coded code in each base frame showing domains which are quantization targets and determined based on power spectrum values of the frequency domain transform coefficients within each domain at the coding side and determines quantization target domains from the plurality of domains using the domain information; and a transform coefficient decoding section that generates the frequency domain transform coefficients included in the quantization target domains from enhancement layer coded code and obtains the enhancement layer signal.

8. The acoustic decoding apparatus according to claim 7, wherein the base layer decoding section decodes the base layer coded code using code excited linear prediction coding.

9. The acoustic decoding apparatus according to claim 7, wherein the transform coefficient decoding section transforms the frequency domain transform coefficients in a time domain signal using an inverse modified discrete cosine transform.

10. An acoustic coding method executed by a processor, the method comprising:

a base layer coding step of encoding an input signal per base frame and generating a base layer coded code in a base layer coding section;

a decoding step of decoding the base layer coded code and generating a decoded signal in a decoding section;

a subtracting step of generating a residual signal between the input signal and the decoded signal in a subtracting section; and a frame division step of dividing the residual signal into a plurality of residual signals in units of an enhancement frame having a shorter time length than the base frame in a frame division section;

an enhancement layer coding step of encoding the plurality of residual signals and generating an enhancement layer coded code in an enhancement layer coding section; and a multiplexing step of multiplexing the base layer coded code and the enhancement layer coded code to output a multiplexed code in a multiplexing section, wherein the enhancement layer coding step comprises:

a frequency domain transform step of transforming the plurality of residual signals in the frequency domain and generating a plurality of frequency domain transform coefficients represented on a two dimensional plane comprised of a time axis and a frequency axis;

a domain division step of dividing the plurality of frequency domain transform coefficients into plurality of domains on the two dimensional plane such that each domain includes at least a plurality of frequency domain transform coefficients which are grouped continuously along a time axis;

a quantization domain determining step of determining a part of the plurality of domains in each base frame to be quantization targets based on power spectrum values of the frequency domain transform coefficients within each domain and outputting domain information showing the part of the plurality of domains; and a quantization domain coding step of encoding the domain information and the frequency domain transform coefficients within the part of the plurality of domains shown by the domain information and generating the enhancement layer coded code.

11. An acoustic decoding method executed by a processor, the method comprising;

a demultiplexing step of demultiplexing a code coded by an acoustic coding apparatus into a base layer coded code and an enhancement layer coded code in a demultiplexing section;

a base layer decoding step of decoding the base layer coded code which is generated at a coding side in predetermined base frame units and generating a base layer signal in a base layer decoding section; and an enhancement layer decoding step of decoding the enhancement layer coded code which is generated at the coding side in units of an enhancement frame having a shorter time length than the base frame and generating an enhancement layer signal in an enhancement layer decoding section;

wherein the enhancement layer decoding step comprises:

a domain division step of, on a two dimensional plane comprised of a time axis and a frequency axis, dividing a plurality of frequency domain transform coefficients into a plurality of domains such that each domain includes at least a plurality of frequency domain transform coefficients which are grouped continuously along a time axis;

a quantization domain determining step of generating domain information from enhancement layer coded code in each base frame showing domains which are quantization targets and determined based on power spectrum values of the frequency domain transform coefficients within each domain at the coding side and determines quantization target domains from the plurality of domains using the domain information; and a transform coefficient decoding step of generating the frequency domain transform coefficients included in the quantization target domains from enhancement layer coded code and generating the enhancement layer signal.

* * * * *